US008306467B2

(12) United States Patent
Baba et al.

(10) Patent No.: US 8,306,467 B2
(45) Date of Patent: Nov. 6, 2012

(54) HEATING DEVICE AND IMAGE FORMING APPARATUS

(75) Inventors: Motofumi Baba, Ebina (JP); Yasuhiro Uehara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 323 days.

(21) Appl. No.: 12/835,342

(22) Filed: Jul. 13, 2010

(65) Prior Publication Data

US 2011/0135356 A1 Jun. 9, 2011

(30) Foreign Application Priority Data

Dec. 7, 2009 (JP) ..... 2009-277781

(51) Int. Cl.
*G03G 15/01* (2006.01)

(52) U.S. Cl. ..... 399/329

(58) Field of Classification Search ..... 399/328, 399/329

See application file for complete search history.

(56) References Cited

U.S. PATENT DOCUMENTS

| | | | |
|---|---|---|---|
| 2003/0095818 | A1 | 5/2003 | Nakayama |
| 2005/0244199 | A1 | 11/2005 | Nakayama |
| 2006/0029444 | A1 | 2/2006 | Naito et al. |

FOREIGN PATENT DOCUMENTS

| | | | |
|---|---|---|---|
| JP | 2003-084591 | A | 3/2003 |
| JP | 2003-091185 | A | 3/2003 |
| JP | 2003-122149 | A | 4/2003 |
| JP | 2003-186322 | A | 7/2003 |
| JP | 2003-223064 | A | 8/2003 |
| JP | 2005-249958 | A | 9/2005 |
| JP | 2006-047768 | A | 2/2006 |

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

A heating device includes: a heating member including a heat generation layer that generates heat by electromagnetic induction, and heating a recording medium by electromagnetic induction heating of the heat generation layer; and a pressure member configured to be movable in a direction approaching or away from the heating member, and forming a nip portion with the heating member therebetween, through which the recording medium passes, the pressure member being configured to include: a nip forming portion that forms the nip portion with the heating member therebetween in a state where the pressure member is set at a position in contact with the heating member while pressing; and a driving force transmission portion that is in contact with the heating member in a state where the nip forming portion is set at a position separated from the heating member and transmits a rotational driving force to the heating member.

12 Claims, 14 Drawing Sheets

HEATING DEVICE AND IMAGE FORMING APPARATUS

CROSS REFERENCE TO RELATED APPLICATIONS

This application is based on and claims priority under 35 USC §119 from Japanese Patent Application No. 2009-277781 filed Dec. 7, 2009.

BACKGROUND

1. Technical Field

The present invention relates to a heating device and an image forming apparatus.

2. Related Art

In a fixing device mounted to an image forming apparatus, such as a copying machine or a printer employing an electrophotographic system, a heating system by use of electromagnetic induction has been known.

SUMMARY

According to an aspect of the present invention, there is provided a heating device including: a heating member including a heat generation layer that generates heat by electromagnetic induction, and heating a recording medium by electromagnetic induction heating of the heat generation layer; and a pressure member configured to be movable in a direction approaching or away from the heating member, and forming a nip portion with the heating member therebetween, through which the recording medium passes, the pressure member being configured to include: a nip forming portion that forms the nip portion with the heating member therebetween in a state where the pressure member is set at a position in contact with the heating member while pressing the heating member; and a driving force transmission portion that is in contact with the heating member in a state where the nip forming portion is set at a position separated from the heating member and transmits a rotational driving force to the heating member.

BRIEF DESCRIPTION OF THE DRAWINGS

An exemplary embodiment of the present invention will be described in detail based on the following figures, wherein.

DETAILED DESCRIPTION

Hereinafter, a first exemplary embodiment according to the present invention will be described in detail with reference to the accompanying drawings.

FIRST EXEMPLARY EMBODIMENT

<Description of Image Forming Apparatus>

Figure 1:
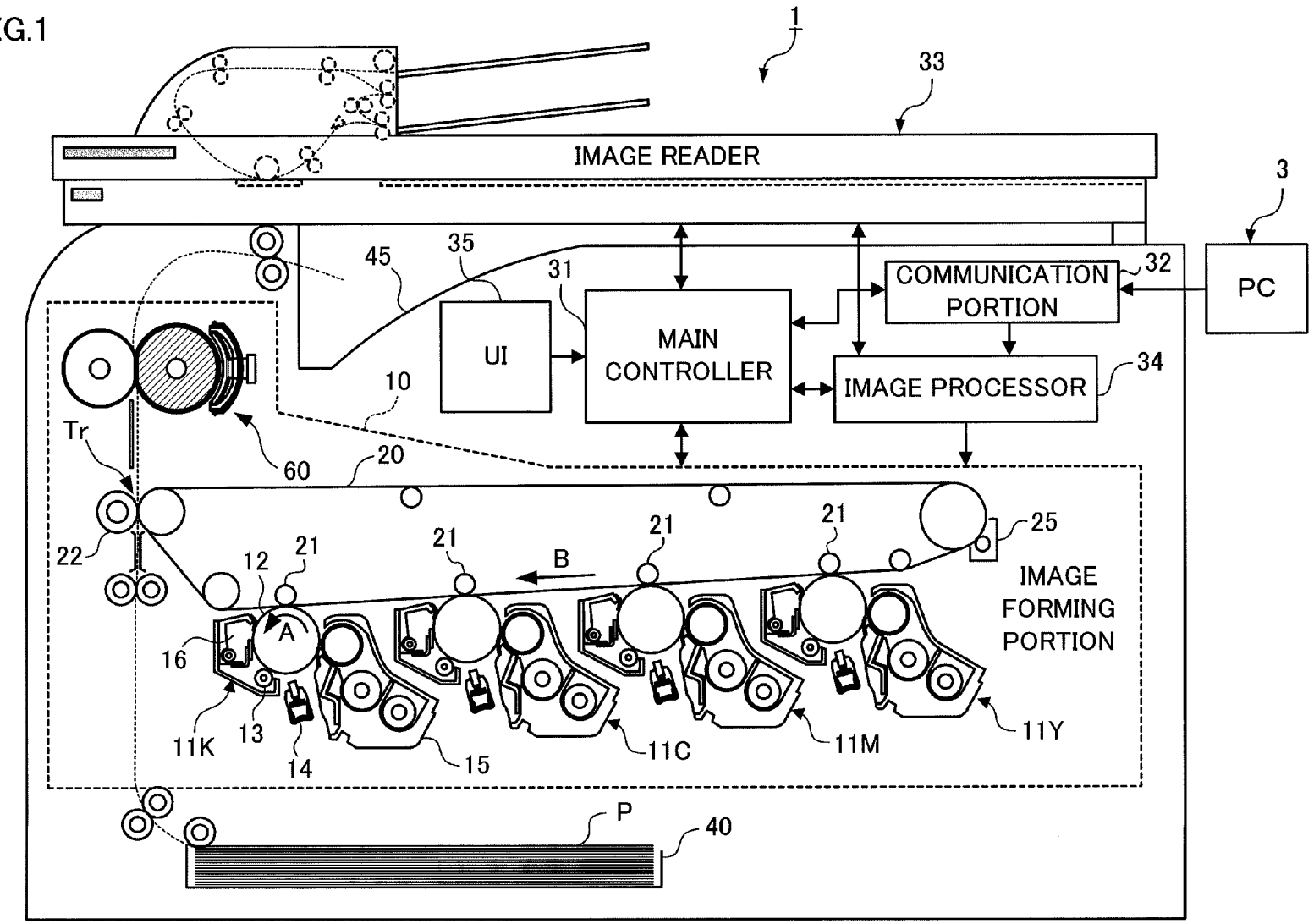
FIG. 1 illustrates a configuration example of an image forming apparatus to which a fixing device of the first exemplary embodiment is applied.

FIG. 1 illustrates a configuration example of an image forming apparatus 1 to which a fixing device (a heating unit or a heating device) 60 of a first exemplary embodiment is applied. The image forming apparatus 1 shown in FIG. 1 is a color printer of a so-called "tandem type", and includes an image forming portion 10 that performs image formation based on image data, and a main controller 31 that controls operation of the entire image forming apparatus 1. The image forming apparatus 1 further includes a communication portion 32 that performs communication with, for example, a personal computer (PC) 3 to receive the image data, an image reader 33 that reads an image from a document and generates read image data, an image processor 34 that carries out predetermined image processing on the image data received by the communication portion 32 or the read image data generated by the image reader 33 and transmits the processed image data to the image forming portion 10, and a user interface (UI) 35 that receives operation input by a user or displays various kinds of information to a user.

The image forming portion 10 is a configuration portion that forms an image by, for example, an electrophotographic system, and includes four image forming units 11Y, 11M, 11C and 11K (hereinafter, collectively referred to as "image forming units 11"), as an example of an image forming unit, arranged in parallel with each other. Each image forming unit 11 includes, as functional members, a photoconductive drum 12 on which an electrostatic latent image, and thereafter a toner image are formed while rotating in the direction of arrow A, a charging unit 13 that charges a surface of the photoconductive drum 12 at a predetermined potential, an exposure unit 14 that exposes the photoconductive drum 12 which has been charged by the charging unit 13 based on the image data, a developing unit 15 that develops the electrostatic latent image formed on the photoconductive drum 12 with toner of each color, and a drum cleaner 16 that cleans the surface of the photoconductive drum 12 after transfer is performed.

The image forming units 11 are configured substantially in the same manner except for toner contained in the developing unit 15, and form respective toner images of yellow (Y), magenta (M), cyan (C) and black (K).

The image forming portion 10 includes an intermediate transfer belt 20 on which the toner image of each color formed by the photoconductive drum 12 of each image forming unit 11 is transferred to be superimposed, and a primary transfer roll 21 that sequentially transfers (primarily transfers) the toner image of each color formed by each of the image forming units 11 onto the intermediate transfer belt 20. The image forming portion 10 further includes a secondary transfer roll 22 that collectively transfers (secondarily transfers) the color toner images transferred to be superimposed on the intermediate transfer belt 20 onto a sheet P as a recording medium (recording paper), and the fixing device 60, as an example of a heating unit (a heating device), that fixes the color toner images having been secondarily transferred onto the sheet P. It should be noted that, in the image forming apparatus 1 of the first exemplary embodiment, the intermediate transfer belt 20, the primary transfer roll 21 and the secondary transfer roll 22 constitute a transfer unit.

The image forming units 11 of the image forming portion 10 form respective toner images of yellow (Y), magenta (M), cyan (C), and black (K) with the electrophotographic process by use of the above-described functional members. The color toner images formed by the image forming units 11 are sequentially subjected to electrostatic transfer onto the intermediate transfer belt 20 by the primary transfer roll 21, thus forming a composite toner image in which toner images of plural colors are superimposed. The composite toner image on the intermediate transfer belt 20 is transported, along a movement of the intermediate transfer belt 20, to a secondary transfer region Tr where the secondary transfer roll 22 is arranged, and electrostatically transferred onto the sheet P supplied from a sheet container 40. Thereafter, the composite toner image electrostatically transferred on the sheet P is subjected to a fixing process by the fixing device 60 to be fixed on the sheet P. The sheet P on which the fixed image is formed is then transported to a sheet stacking portion 45 provided to an exit portion of the image forming apparatus 1 to be stacked.

Meanwhile, toner adhered to the photoconductive drum 12 after the primary transfer is performed (residual toner after the primary transfer) and toner adhered to the intermediate transfer belt 20 after the secondary transfer is performed (residual toner after the secondary transfer) are removed by the drum cleaner 16 and a belt cleaner 25, respectively. Thus the image forming processing in the image forming apparatus 1 is repeated in cycles for the number of prints to be produced.

<Description of Entire Configuration of Fixing Unit>

Next, the fixing device 60 of the first exemplary embodiment will be described.

Figure 2:
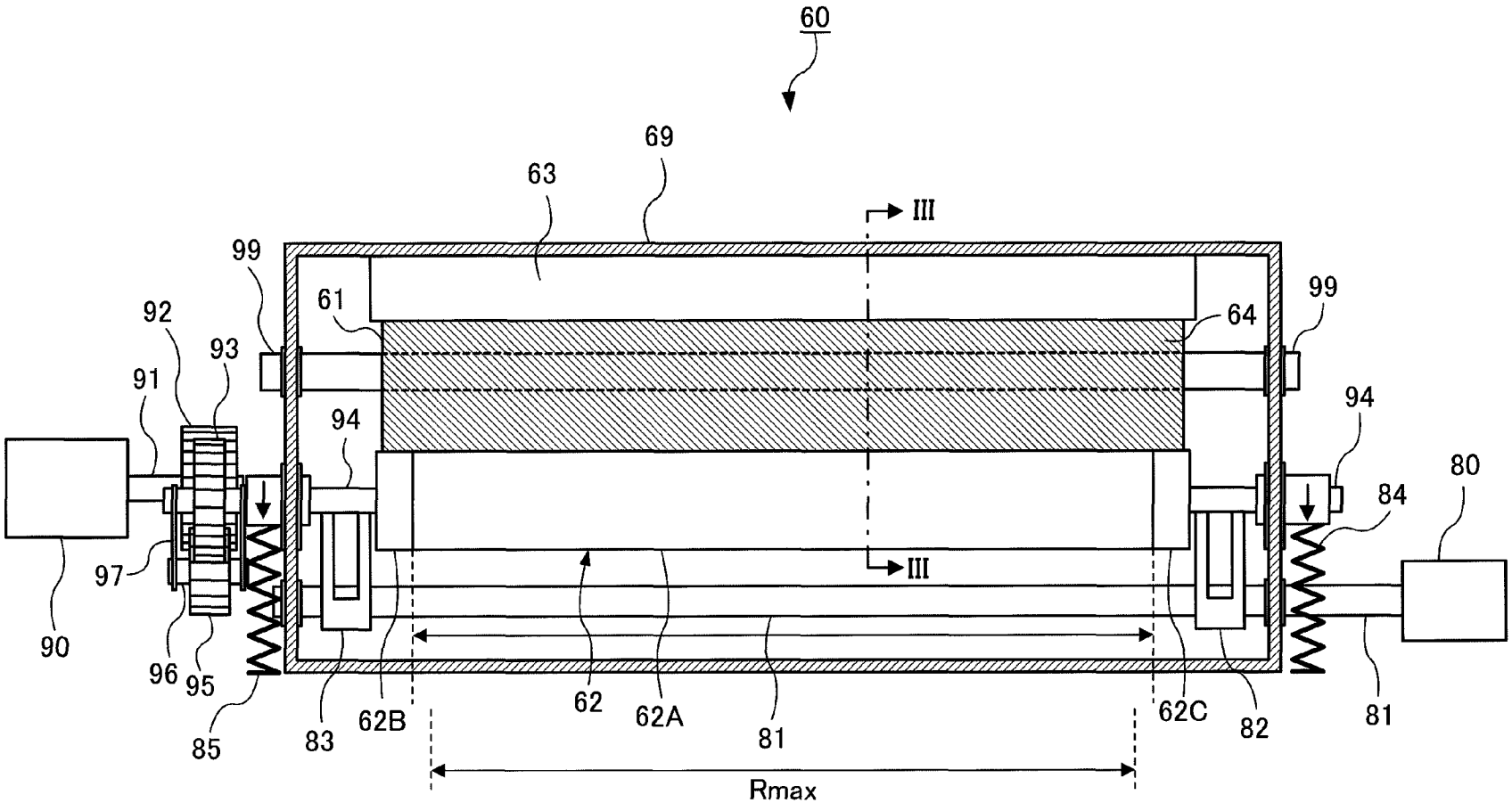
FIG. 2 is an elevational view illustrating a configuration of the fixing device.
Figure 3:
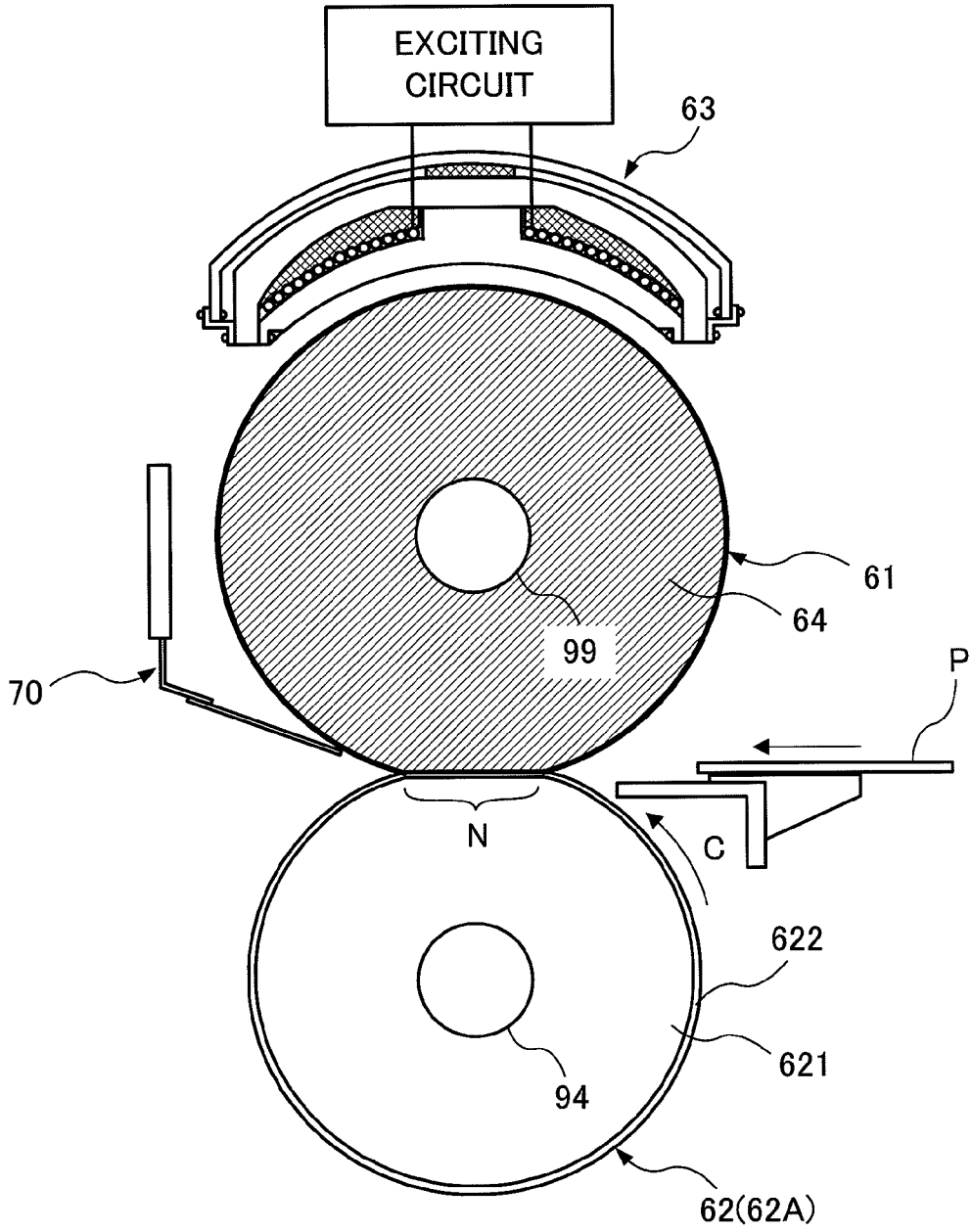
FIG. 3 is a cross-sectional view taken from line of FIG. 2 that illustrates the configuration of the fixing device.

FIGS. 2 and 3 illustrate the configuration of the fixing device 60 of the first exemplary embodiment. FIG. 2 is an elevational view of the fixing device 60 as viewed from a direction in which the sheet P is inserted, and FIG. 3 is a cross-sectional view of the fixing device 60 taken from line III-III of FIG. 2.

As shown in FIGS. 2 and 3, the fixing device 60 includes, inside a support body 69 (refer to FIG. 2), an induction heater (IH) 63, as an example of a heating member and a magnetic field generating member that forms an alternating magnetic field, a fixing belt 61, as an example of a heating member, that fixes the toner image upon receiving electromagnetic induction heating from the IH 63, an elastic member 64 arranged inside the fixing belt 61, a pressure roll 62, as an example of a pressure member, arranged to face the fixing belt 61, and an auxiliary peeling member 70 (refer to FIG. 3) that assists in peeling the sheet P from the fixing belt 61.

<Description of Fixing Belt>

Figure 4:
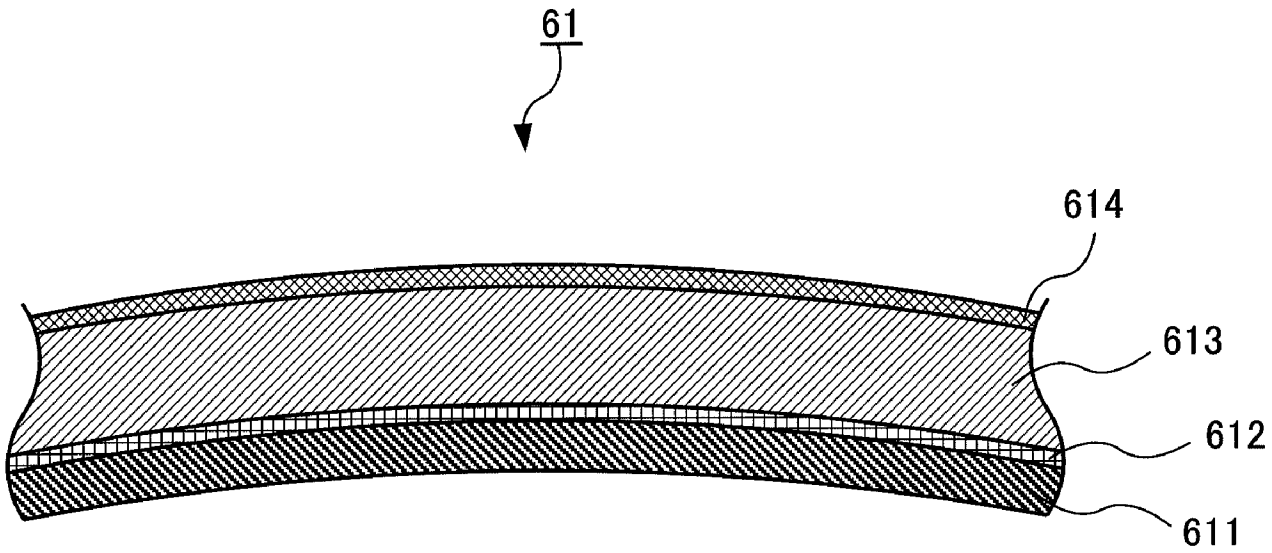
FIG. 4 is a cross-sectional layer configuration view of a fixing belt.

The fixing belt 61 is configured with an endless belt member which has a cylindrical shape in a basic form thereof, and is formed to have, for example, a diameter of 30 mm and a length in a width direction of 380 mm in the basic form thereof (cylindrical shape). Moreover, as shown in FIG. 4 (a cross-sectional view of layer configuration of the fixing belt 61), the fixing belt 61 is configured to have a multi-layer structure including a base layer 611, a conductive heat generation layer 612 laminated on the base layer 611, an elastic layer 613 that improves fixing capability of a toner image, and a surface release layer 614 placed as an outermost layer.

The base layer 611 of the fixing belt 61 supports the conductive heat generation layer 612, which is a thin layer, and is configured with a heat-resistant sheet-like member that ensures a mechanical strength of the fixing belt 61 as a whole. Further, the base layer 611 is made of a material having a property for passing through a magnetic field (relative magnetic permeability or specific resistance) and a thickness therefor, and the base layer 611 itself is configured not to generate heat or to rarely generate heat under the influence of the magnetic field. Specifically, for example, a non-magnetic metal such as non-magnetic stainless steel with a thickness of from about 30 to about 200 μm, a resin material with a thickness of from about 60 to about 200 μm, and so forth, are employed to form the base layer 611.

The conductive heat generation layer 612 of the fixing belt 61 is an example of a heat generation layer, and is an electromagnetic induction heating body layer that receives electromagnetic induction heating by the alternating magnetic field generated by the IH 63. In other wards, the conductive heat generation layer 612 induces an eddy current by passing through the alternating magnetic field from the IH 63 in a thickness direction thereof.

Here, a frequency of the alternating magnetic field generated by the IH 63 is from about 20 to about 100 kHz by a general power supply that is widely used. Therefore, the conductive heat generation layer 612 is configured such that an alternating magnetic field of frequency of from about 20 to about 100 kHz may enter and pass therethrough. As a material for constituting the conductive heat generation layer 612, for example, a metal such as Au, Ag, Al, Cu, Zn, Sn, Pb, Bi, Be, Sb and so forth or an alloy of any combination thereof may be employed.

Specifically, as a configuration of the conductive heat generation layer 612, a non-magnetic metal (paramagnetic material with relative magnetic permeability of about 1) such as Cu having a thickness of from about 2 to 20 μm and a specific resistance of about $2.7\times10^{-8}$ Ω·m or less is used. The conductive heat generation layer is formed to be a thin layer to reduce heat capacity from a standpoint of reduction of time required to heat the fixing belt 61 until reaching a temperature capable of performing fixing (hereinafter, referred to as "warm-up time").

The elastic layer 613 of the fixing belt 61 is composed of a heat-resistant elastic body such as silicone rubber. The toner image held on the sheet P, which is a target to be fixed, is formed by laminating toner of each color that is a powder. To uniformly supply heat to the entire toner image in a nip portion N, the elastic layer 613 is configured to deform to follow projections and depressions on the toner image on the sheet P. For example, as the elastic layer 613, silicone rubber with a thickness of from about 100 to about 600 μm and a JIS-A hardness of from about 10 to about 30 may be used.

The surface release layer 614 of the fixing belt 61 is directly brought into contact with the unfixed toner image held on the sheet P, and accordingly, a material having a high release capability with respect to toner may be used as the surface release layer 614. For example, PFA (tetrafluoroethylene/perfluoroalkyl vinyl ether copolymer resin), PTFE (polytetrafluoroethylene), silicone copolymer, or a complex layer including any combination thereof may be used for the surface release layer 614. If the surface release layer 614 is too thin, wear resistance thereof is insufficient. On the other hand, if the surface release layer 614 is too thick, heat capacity of the fixing belt 61 becomes too large, which results in long warm-up time. Accordingly, the thickness of the surface release layer 614 is set to from about 1 to about 50 μm in consideration of a balance between the wear resistance and the heat capacity.

It should be noted that the fixing belt 61 may have a single layer configuration made of a single material. For example, the fixing belt 61 may be configured to have a single layer made of metal such as Ni with a thickness of about 50 μm.

<Description of Elastic Member>

In the fixing device 60 of the first exemplary embodiment, inside the fixing belt 61, the elastic member 64 is arranged across the entire width of the fixing belt 61. The elastic member 64 is formed with a cylindrical roll having an outer diameter of about 30 mm which is configured by, for example, an elastic body such as rubber having JIS-A rubber hardness of from about 15 to about 45, elastomer (for example, silicone rubber), and so forth, and is fitted over a rotating shaft 99 to be secured (glued). Further, an outer circumferential surface of the elastic member 64 is bonded to an inner circumferential surface of the fixing belt 61. Thereby, the fixing belt 61 has a configuration such that an elastic roll including the rotating shaft 99 and the elastic member 64 is inserted inside thereof, and is driven and rotated with the rotation of the rotating shaft 99.

In this case, the fixing belt 61 may be configured such that the outer diameter of the elastic member inserted inside the fixing belt 61 is slightly larger than the diameter (for example, 30 mm) of the fixing belt 61 in its basic form (cylindrical shape). This improves bonding capability between the outer circumferential surface of the elastic member 64 and the inner circumferential surface of the fixing belt 61. For example, by setting the outer diameter of the elastic member 64 to 31 mm, which is larger by 1 mm than the diameter of 30 mm of the fixing belt in its basic form, the bonding capability between the elastic member 64 and the fixing belt 61 is increased due to an elastic force from the elastic member 64.

With such a configuration, the pressure roll 62 is arranged to be brought into press-contact (contacts while pressing) with the fixing belt 61 by a contact/retraction mechanism that is described later, and thereby the fixing belt 61 forms the nip portion N with the pressure roll 62 therebetween due to the elastic force of both elastic member 64 and the pressure roll 62. On the other hand, when a roll main body portion 62A of the pressure roll 62 is arranged to be separated from the fixing belt 61 by the contact/retraction mechanism, the basic form (cylindrical shape) of the entire fixing belt 61 is restored. The function of the elastic member 64 will be described in detail later (with reference to FIGS. 8A and 8B).

Further, as shown in FIG. 2, the fixing belt 61 having such a configuration is rotatably supported by the support body 69 at both ends of the rotating shaft 99 thereof. In the state where the pressure roll 62 is in press-contact with the fixing belt 61 by the contact/retraction mechanism, the pressure roll 62 is in press-contact across the entire width of the fixing belt 61, and accordingly, the fixing belt 61 rotates to follow the pressure roll 62 by a frictional force applied from the entire pressure roll 62. Meanwhile, in the state where the roll main body portion 62A of the pressure roll 62 is separated from the fixing belt 61, power transmission portions 62B and 62C (also refer to FIGS. 5A and 5B) provided to both end portions of the pressure roll 62 are in press-contact with both end portions of the fixing belt 61, and the fixing belt 61 rotates to follow the pressure roll 62 by the frictional force applied by the power transmission portions 62B and 62C. A mechanism for driving the fixing belt 61 and the pressure roll 62 will be described in detail later (with reference to FIGS. 8A and 8B).

<Description of Pressure Roll>

As shown in FIG. 2, the pressure roll 62 is configured, in a longitudinal direction thereof, with the roll main body portion 62A in a region including a sheet passing region of a largest size (for example, A3) sheet (maximum sheet passing region Rmax) and the power transmission portions 62B and 62C formed in both end portions of the roll main body portion 62A (regions outside of the maximum sheet passing region Rmax). The power transmission portions 62B and 62C are configured such that an elastic deformation ratio thereof with respect to the pressure at the nip portion N where the pressure roll 62 is brought into press-contact (contacts while pressing) with the fixing belt 61 is larger than that of the roll main body portion 62A. Here, "elastic deformation ratio" means an amount of elastic deformation per unit volume when a nip pressure is applied.

Further, as shown in FIG. 3, the roll main body portion 62A of the pressure roll 62 is configured with a heat-resistant elastic layer 621 that is made of, for example, foamed silicone rubber or the like, and a release layer 622 formed by a heat-resistant rubber coating or a heat-resistant resin coating such as PFA containing carbon with a thickness of, for example, about 50 μm. The roll main body portion 62A of the pressure roll 62 is formed to have an outer diameter of about 28 mm and a length in the width direction of about 370 mm. Accordingly, the entire pressure roll 62, added with the power transmission portions 62B and 62C each having a length in the longitudinal direction of about 10 mm, is formed to have a length in the longitudinal direction of about 390 mm. The entire pressure roll 62 is arranged in parallel to the fixing belt 61 along the direction of the rotating shaft 99 of the fixing belt 61, and is configured, as will be described next, to contact with and retract from the fixing belt 61 by the contact/retraction mechanism.

Moreover, as shown in FIG. 2 (also refer to FIGS. 6A and 6B), the pressure roll 62 is provided with a rotating shaft 94 that pierces the center of rotation of the pressure roll 62. While a drive transmission gear 93 is secured to one end portion of the rotating shaft 94, in the support body 69, the rotating shaft 94 is supported to be movable within a predetermined range in a direction substantially orthogonal to the rotating shaft 94, as well as rotatable. The pressure roll 62 receives a driving force from a drive motor 90 via the drive transmission gear 93, and rotates in a direction of arrow C in FIG. 3. Thereby, the pressure roll 62 causes the fixing belt 61 to rotate to follow the pressure roll 62. At that time, the pressure roll 62 forms the nip portion N at a position in contact with the fixing belt 61 while pressing the fixing belt 61. The sheet P holding an unfixed toner image is passed through the nip portion N, and thus the unfixed toner image is fixed onto the sheet P by heat and pressure.

<Description Of Configuration of Pressure Roll in Longitudinal Direction>

Figure 5A:
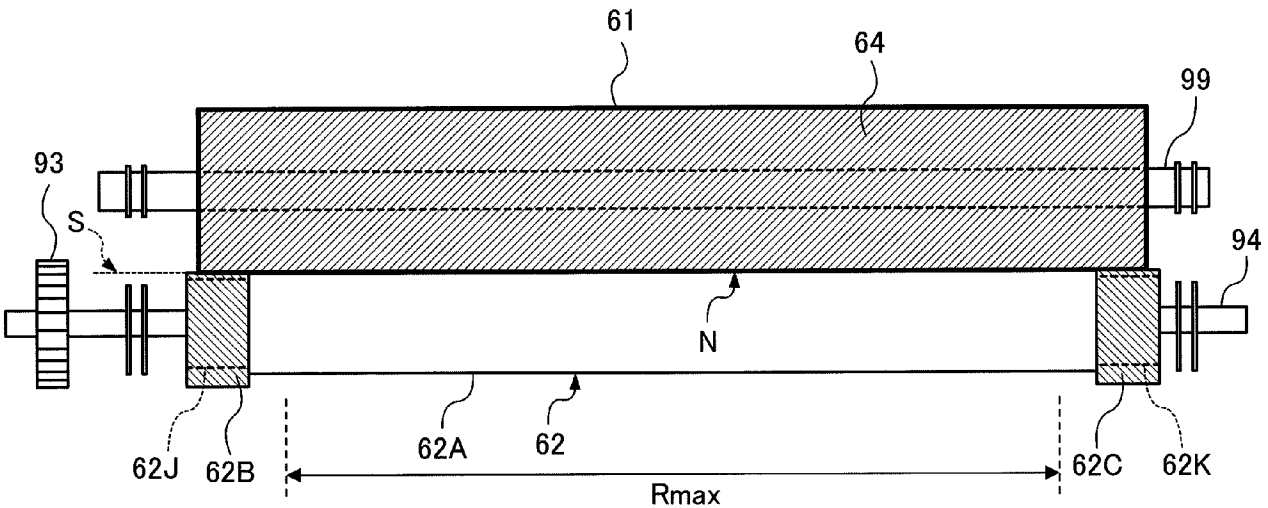
FIGS. 5A and 5B illustrate a configuration of a pressure roll in a longitudinal direction.
Figure 5B:
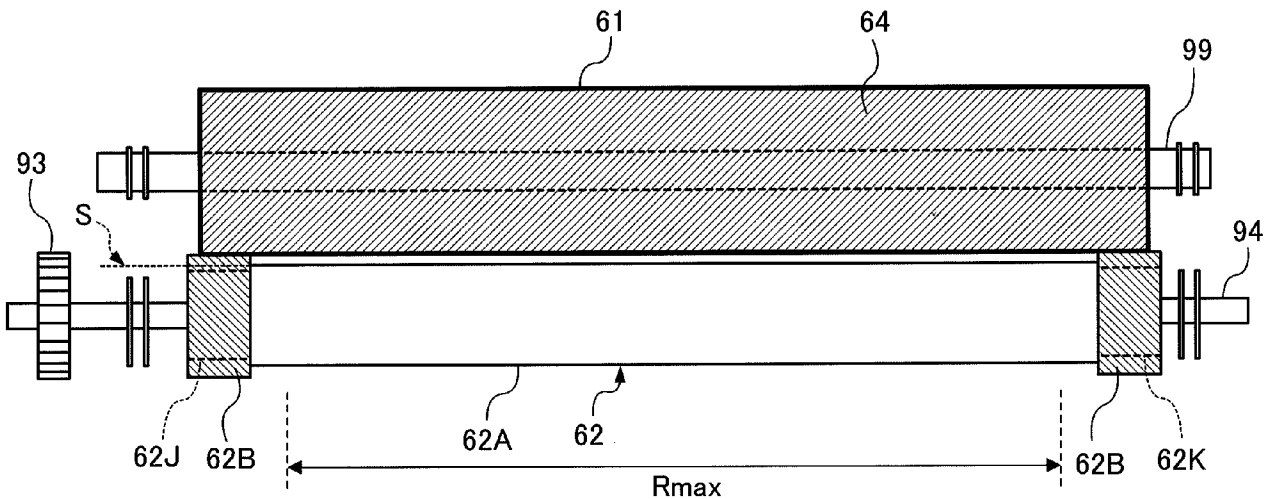

FIGS. 5A and 5B illustrate the configuration of the pressure roll 62 in the longitudinal direction. FIG. 5A illustrates the pressure roll 62 in the state of being in press-contact with the fixing belt 61 by the contact/retraction mechanism (hereinafter, referred to as "retraction mechanism"), and FIG. 5B illustrates the roll main body portion 62A of the pressure roll 62 in the state of being separated from the fixing belt 61.

As shown in FIG. 5A, in the pressure roll 62 of the first exemplary embodiment, the nip portion N (also refer to FIG. 3) is formed by the elastic member 64 that has been elastically deformed upon receiving a pressing force from the roll main body portion 62A, as an example of a nip forming portion, in the pressure roll 62 and the roll main body portion 62A that has been elastically deformed upon receiving a reaction force from the elastic member 64, when the pressure roll 62 is brought into press-contact with the fixing belt 61 by the retraction mechanism. At that time, the power transmission portions 62B and 62C, which is configured to have a larger elastic deformation ratio than the roll main body portion 62A, is compressed to have a surface position that coincides with a surface position S of the roll main body portion 62A in the nip portion N. That is, the power transmission portion 62B and 62C are configured with an elastic body of a foamed silicone rubber having a JIS-A rubber hardness of from about 15 to about 35 (sponge), and supported by power transmission support portion 62J and 62K that are formed to have diameters smaller than that of the roll main body portion 62A. Accordingly, the power transmission portions 62B and 62C are compressed into spaces which is formed by a difference between the outer diameter of the power transmission support portions 62J and 62K and the outer diameter of the roll main body portion 62A elastically deformed upon receiving the reaction force from the elastic member 64, and thus the surface positions of the power transmission portions 62B and 62C coincide with the surface position S of the roll main body portion 62A having been elastically deformed. As a result, the nip pressure at the nip portion N is hardly affected by the power transmission portions 62B and 62C even at regions of both end portions thereof, and is uniformly set across the width direction thereof mainly by the balance of elastic forces between the roll main body portion 62*a* and the elastic member 64.

Next, as shown in FIG. 5B, when the retraction mechanism moves the pressure roll 62, the retraction mechanism moves the pressure roll 62 to a position in which the roll main body portion 62A is separated from the fixing belt 61 and the power transmission portions 62B and 62C are kept in the state of being in press-contact (contacts while pressing) with the fixing belt 61. That is, the retraction mechanism moves the pressure roll 62 to a position where the roll main body portion 62A is absolutely separated from the fixing belt 61, though the power transmission portions 62B and 62C are in press-contact with the fixing belt 61. By rotating the pressure roll 62 in such a state, a rotational driving force from the pressure roll 62 is transmitted to the fixing belt 61 by the frictional force between the fixing belt 61 and the power transmission portions 62B and 62C, as an example of a driving force transmission portion, in the pressure roll 62. Thus the pressure roll 62 causes the fixing belt 61 to rotate to follow the pressure roll 62 in the state where the roll main body portion 62A is absolutely separated from the fixing belt 61.

<Description of Configuration of Power Transmission Portion in Pressure Roll>

Figure 6A:
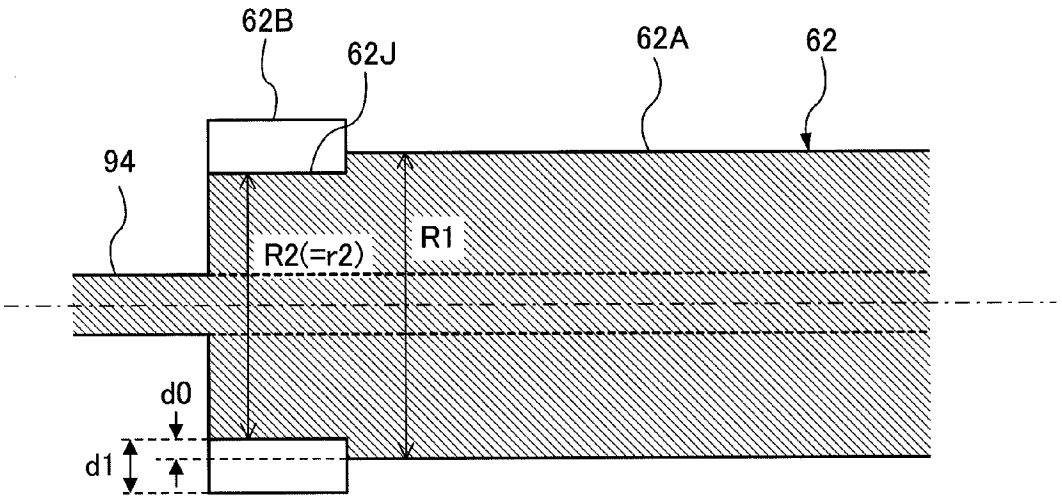
FIGS. 6A and 6B specifically illustrate a configuration of power transmission portions of the pressure roll.
Figure 6B:
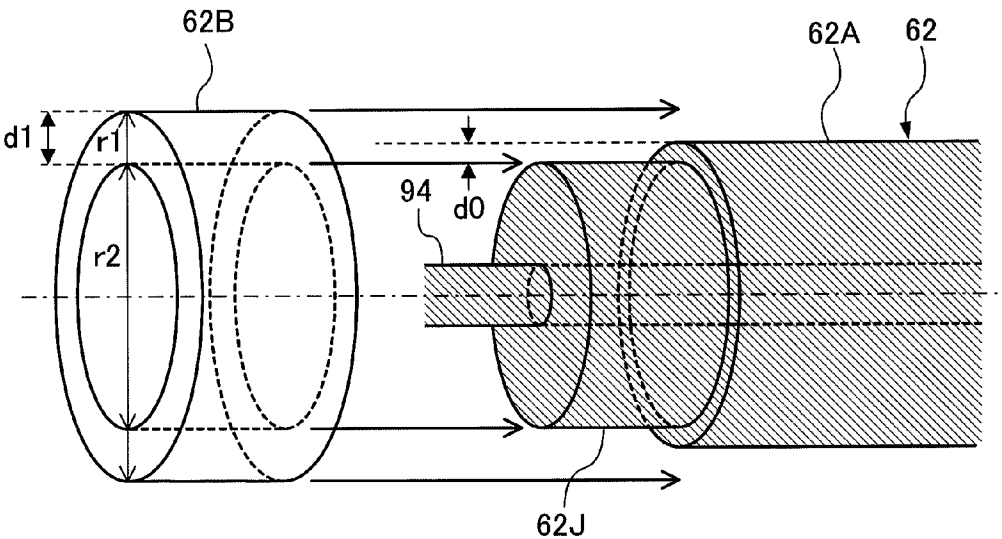

FIGS. 6A and 6B specifically illustrate the configuration of the power transmission portions 62B and 62C in the pressure roll 62. FIG. 6A illustrates a cross-sectional configuration of the power transmission portions 62B and 62C, and FIG. 6B is a perspective view showing an assembly configuration of the power transmission portions 62B and 62C. It should be noted that FIGS. 6A and 6B only show the power transmission portion 62B, which is on one end portion side of the pressure roll 62, however, the power transmission portion 62C on the other end portion side is configured in the same manner.

As shown in FIG. 6B, the power transmission portions 62B and 62C are attached to fitted over the power transmission support portions 62J and 62K formed integrally with the roll main body portion 62A, thereby secured to the power transmission support portions 62J and 62K. The power transmission portions 62B and 62C are formed to have, for example, a wall thickness d1, which is one-half of a difference between an outer diameter r1 (about 32 mm) and an inner diameter r2 (about 26 mm) (=(r1−r2)/2), of about 3 mm. Meanwhile, as shown in FIG. 6A, the power transmission support portions 62J and 62K, which support the power transmission portions 62B and 62C, are formed to have an outer diameter R2 of about 26 mm, which is same as the inner diameter r2 of the power transmission portions 62B and 62C. Accordingly, in the power transmission support portions 62J and 62K, a difference d0, which is one-half of the difference between the outer diameter thereof and the outer diameter R1 (about 28 mm) of the roll main body portion 62A, is set to about 1 mm.

On the other hand, when the retraction mechanism separates the pressure roll 62 from the fixing belt 61, the retraction mechanism sets the gap between the roll main body portion 62A and the fixing belt 61 to, for example, about 1.5 mm. Consequently, in the state where the roll main body portion 62A is separated from the fixing belt 61 by the retraction mechanism, the power transmission portions 62B and 62C with a wall thickness of about 3 mm are compressed and deformed to have a wall thickness of about 2.5 mm, which is a sum of the gap of about 1.5 mm and the difference d0 of about 1 mm, and is brought into contact (press-contact) with the fixing belt 61 in that state. Accordingly, as shown in FIG. 5B, the fixing belt 61 receives the frictional force due to the elastic force from the power transmission portions 62B and 62C in the state of being compressed and deformed to have the wall thickness d1 thereof is decreased from about 3 mm to about 2.5 mm, for example, and is rotated to follow the rotation of the pressure roll 62. Since the fixing belt 61 in this case does not perform transporting operation of the sheet P, a driving torque required to drive the fixing belt 61 is small, for example, from about 0.05 to 0.1 N. Therefore, the fixing belt 61 is rotated to follow the pressure roll 62 to a sufficient degree by the frictional force from the power transmission portions 62B and 62C on the basis of the elastic force thereof in the compressed and deformed state.

Further, when the retraction mechanism brings the pressure roll 62 into press-contact with the fixing belt 61, as shown in FIG. 5A, the power transmission portions 62B and 62C are compressed into the spaces formed by the difference d0 (about 1 mm) between the surface position S of the roll main body portion 62A and the outer circumferential surfaces of the power transmission support portions 62J and 62K, and thereby surface positions of the power transmission portions 62B and 62C coincide with the surface position S of the roll main body portion 62A which has been elastically deformed. Accordingly, the nip pressure in the nip portion N is uniformly set across the width direction of the pressure roll 62 mainly by the balance of the elastic forces between the roll main body portion 62A and the elastic member 64.

It should be noted that a backup member, constituted by a thin-walled cylindrical member made of a material with stiffness higher than that of the elastic member 64 (with lower elastic deformation ratio), may be provided at regions of the elastic member 64 inside the fixing belt 61, the regions facing the power transmission portions 62B and 62C. This leads to more reliability in elastic compression of the power transmission portions 62B and 62C in an assumed amount of deformation in accordance with the state where the roll main body portion 62A of the pressure roll 62 is in press-contact with the fixing belt 61 by the retraction mechanism and the state where the roll main body portion 62A is separated from the fixing belt 61.

Specifically, since the backup member having high stiffness (low elastic deformation ratio) receives the pressing force from the power transmission portions 62B and 62C, the power transmission portions 62B and 62C are more likely to be elastically deformed in the assumed amount of deformation. Consequently, in the state where the roll main body portion 62A is in press-contact with the fixing belt 61, the reliability is ensured in compressing the power transmission portions 62B and 62C into the spaces formed by the difference d0 between the surface position S of the roll main body portion 62A and the outer circumferential surfaces of the power transmission support portions 62J and 62K. Further, in the state where the roll main body portion 62A is separated from the fixing belt 61, the power transmission portions 62B and 62C have ensured reliability in contacting (press-contacting) the fixing belt 61 in an assumed state of compressed deformation.

<Description of Contact/Retraction Mechanism of Pressure Roll>

Next, the retraction mechanism (contact/retraction mechanism), as an example of a moving unit, that moves the above-described pressure roll 62 in a direction approaching or away from the fixing belt 61 will be described.

As shown in FIG. 2, as the retraction mechanism, the fixing device 60 of the first exemplary embodiment includes: a rotating shaft 81 that is rotatably supported by the support body 69; a displacement motor 80 that displaces the rotating shaft 81 in a predetermined angle range; and cams 82 and 83 that are secured to regions of both end portions of the rotating shaft 81 that face the rotating shaft 94 of the pressure roll 62 to be swingable according to the displacement of the rotating shaft 81. The fixing device 60 further includes springs 84 and 85 that are connected to regions of both end portions of the rotating shaft 94 of the pressure roll 62 for urging the pressure roll 62 in a direction away from the fixing belt 61 (direction of arrows).

Figure 7B:
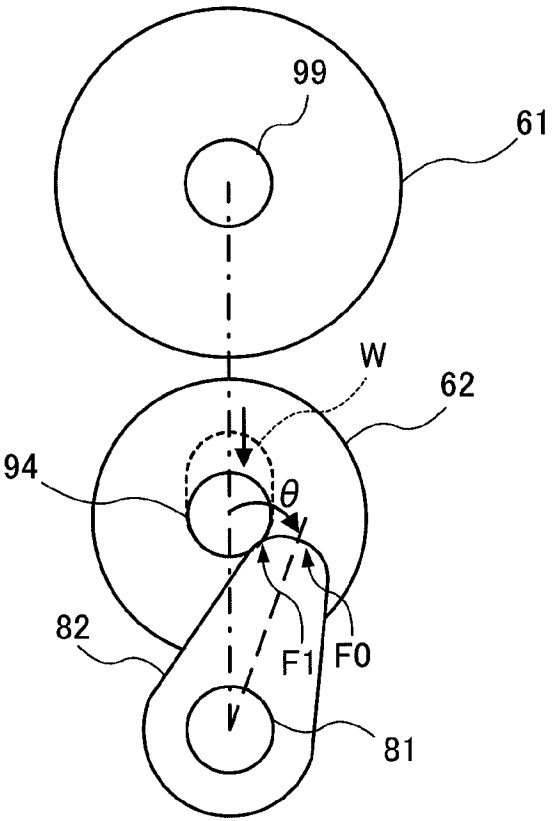
FIGS. 7A and 7B illustrate operation in which a retraction mechanism causes a roll main body portion of the pressure roll to be brought into contact with or separated from the fixing belt.
Figure 7A:
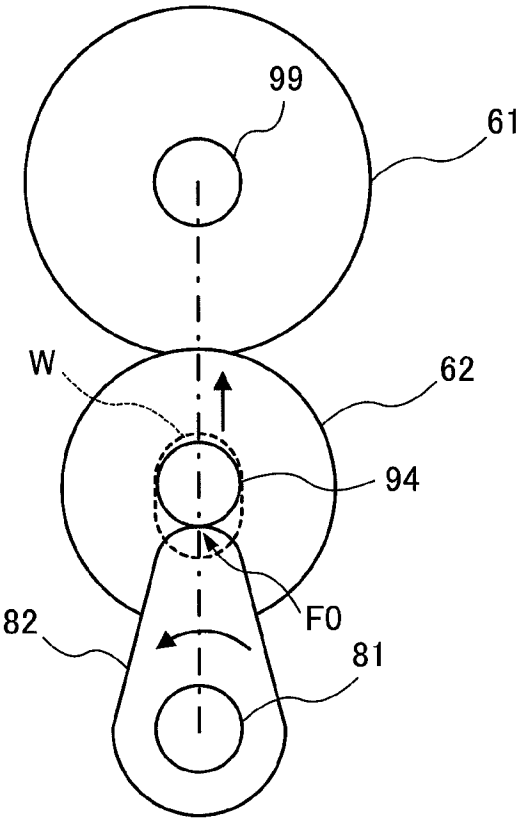

FIGS. 7A and 7B illustrate operation in which the retraction mechanism causes the roll main body portion 62A of the pressure roll 62 to be brought into contact with or separated from the fixing belt 61. First, as shown in FIG. 7A, in a state where the displacement motor 80 displaces the rotating shaft 81 so that top portions F0 of the cams 82 and 83 (the cam 82 is representatively shown in FIGS. 7A and 7B) face toward the rotating shaft 99 of the fixing belt 61, the top portion F0 of the cam 82 (the cam 83) presses the rotating shaft 94 of the pressure roll 62 toward the fixing belt 61 (in a direction of an arrow) against an urging force by the springs 84 and 85. Thereby, the pressure roll 62 is set to a position where the roll main body portion 62A presses the elastic member 64 with the fixing belt 61 interposed therebetween.

Next, as shown in FIG. 7B, in a state where the displacement motor 80 displaces the rotating shaft 81 so that the top portion F0 of the cam 82 (the cam 83) is inclined from the direction of the rotating shaft 99 at an angle θ, the rotating shaft 94 of the pressure roll 62 is moved by the urging force of the springs 84 and 85 (refer to FIG. 2) in a direction away from the fixing belt 61 (in a direction of an arrow in FIG. 7B) along a side surface F1 of the cam 82 (the cam 83) within a movement restriction region W set in the support body 69. Accordingly, the pressure roll 62 is set to a position where the roll main body portion 62A is separated from the fixing belt 61.

The movement restriction region W set in the support body 69 is configured such that, when the pressure roll 62 is moved in a direction away from the fixing belt 61, the gap between the roll main body portion 62A of the pressure roll 62 and the fixing belt 61 is in a range in which the power transmission portions 62B and 62C are kept in the state of being in press-contact with the fixing belt 61, for example, the gap between the roll main body portion 62A and the fixing belt 61 is set to about 1.5 mm.

As described above, the roll main body portion 62A of the pressure roll 62 is brought into contact with or separated from the fixing belt 61 by the retraction mechanism. The contact/retraction operation of the pressure roll 62 is performed by the retraction mechanism in starting or finishing of the fixing operation by the fixing device 60. That is, the pressure roll 62 is set to be brought in press-contact (contacts while pressing) with the fixing belt 61 in accordance with the start of the fixing operation. Consequently, in the fixing operation, the pressure roll 62, which receives the rotational driving force from the drive motor 90 (refer to FIG. 2), causes the fixing belt 61 to rotate to follow the pressure roll 62. Before the fixing operation is performed, the roll main body portion 62A of the pressure roll 62 is kept in the state of being separated from the fixing belt 61, and the fixing belt 61 is rotated under the state to perform an operation of heating the fixing belt 61 by the IH 63 up to a temperature enabling fixing (hereinafter, referred to as "warm-up operation").

<Description of Drive Mechanism of Fixing Belt>

Next, a mechanism for driving the pressure roll 62 (hereinafter, referred to as "drive mechanism") will be described.

As shown in FIG. 2, as the drive mechanism, the fixing device 60 of the first exemplary embodiment includes: a drive motor 90 as a drive source; a drive transmission gear 92 secured to a rotating shaft 91 of the drive motor 90; and a drive transmission gear 93 secured to a rotating shaft 94 of the pressure roll 62. The fixing device 60 further includes: a swingable support member 97 that is swingably supported by the rotating shaft 94 of the pressure roll 62; and a transmission gear 95 that is secured to a rotating shaft 96 rotatably supported by the swingable support member 97 and coupled to the drive transmission gear 93 of the pressure roll 62. The transmission gear 95 is maintained to be coupled to the drive transmission gear 93 of the pressure roll 62 via the swingable support member 97 even though the contact/retraction operation of the pressure roll 62 is performed by the retraction mechanism. The swingable support member 97 is urged by a not-shown urging unit toward the drive transmission gear 92 so that the transmission gear 95 is pressed toward the drive transmission gear 92 of the drive motor 90 side.

Subsequently, transmission of the driving force from the drive motor 90 in the drive mechanism of the fixing device 60 will be described. As described above, the pressure roll 62 is subjected to the contact/retraction operation with respect to the fixing belt 61 by the retraction mechanism. Therefore, the drive mechanism of the fixing device 60 is configured such that the driving force is transmitted from the drive motor 90 to the pressure roll 62 in both states of the roll main body portion 62A of the pressure roll 62 being in press-contact with and separated from the fixing belt 61.

Figure 8A:
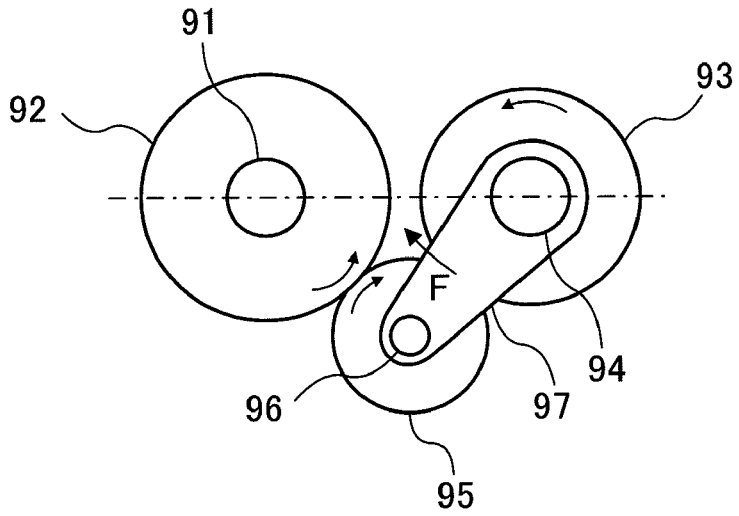
FIGS. 8A and 8B illustrate transmission of a driving force from a drive motor to the pressure roll.
Figure 8B:
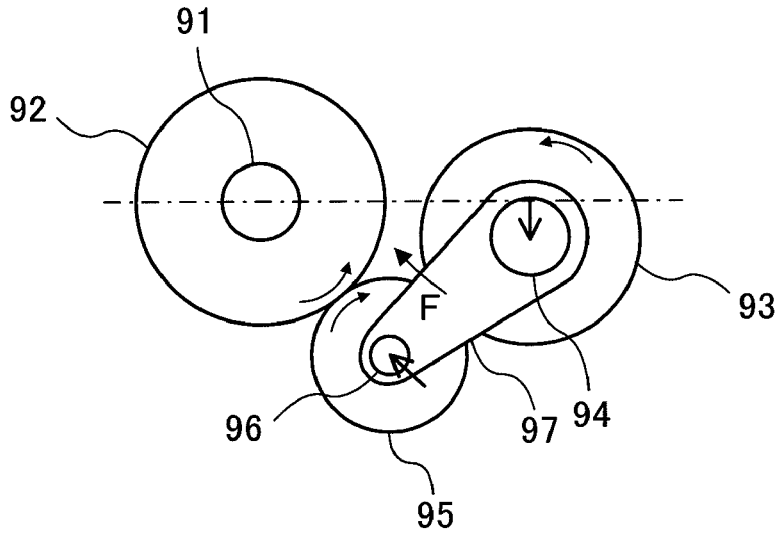

FIGS. 8A and 8B illustrate the transmission of the driving force from the drive motor 90 to the pressure roll 62. FIG. 8A shows the state where the pressure roll 62 is in press-contact with the fixing belt 61 by the retraction mechanism, and FIG. 8B shows the state where the roll main body portion 62A of the pressure roll 62 is separated from the fixing belt 61.

As described above, an urging force F toward the drive transmission gear 92 is applied to the swingable support member 97 by the not-shown urging unit so that the transmission gear 95 is pressed toward the drive transmission gear 92 of the drive motor 90 side. For this reason, as shown in FIG. 8A, in the state where the pressure roll 62 is in press-contact with the fixing belt 61, the transmission gear 95 supported by the swingable support member 97, to which the urging force F toward the drive transmission gear 92 side is applied, is coupled to the drive transmission gear 92 of the drive motor 90 side. The transmission gear 95 is also coupled to the drive transmission gear 93 of the pressure roll 62 side. Consequently, by the coupling between the drive transmission gear 92 of the drive motor 90 side and the transmission gear 95 and the coupling between the transmission gear 95 and the drive transmission gear 93 of the pressure roll 62 side, the rotational driving force from the drive motor 90 is transmitted to the pressure roll 62 side, thereby driving and rotating the pressure roll 62. The pressure roll 62 causes the fixing belt 61 to rotate to follow the pressure roll 62.

Further, as shown in FIG. 8B, when the roll main body portion 62A of the pressure roll 62 is separated from the fixing belt 61, the rotating shaft 94 of the pressure roll 62 side and the drive transmission gear 93 are moved in a direction away from the fixing belt 61 (direction of an arrow in the figure). Then the transmission gear 95 is moved in a direction toward the drive transmission gear 92 of the drive motor 90 side (direction of an arrow in the figure) due to the swing of the swingable support member 97, to which the urging force F toward the drive transmission gear 92 is applied, and thereby the coupled state between the drive transmission gear 92 of the drive motor 90 side and the transmission gear 95 is maintained. Accordingly, even in the state where the roll main body portion 62A of the pressure roll 62 is separated from the fixing belt 61, the rotational driving force from the drive motor 90 is transmitted to the pressure roll 62 by the coupling between the drive transmission gear 92 of the drive motor 90 side and the transmission gear 95 and the coupling between the transmission gear 95 and the drive transmission gear 93 of the pressure roll 62 side, thus rotating and driving the pressure roll 62. Further, the power transmission portions 62B and 62C of the pressure roll 62 rotate the fixing belt 61 to follow the pressure roll 62.

As described above, in the fixing device 60 of the first exemplary embodiment, in the case where the fixing operation is not started yet and the roll main body portion 62A of the pressure roll 62 is set to the state of not in press-contact with the fixing belt 61 by the retraction mechanism, the rotational driving force is transmitted to the pressure roll 62 by the above-described drive mechanism, and the power transmission portions 62B and 62C rotate the fixing belt 61 to follow the pressure roll 62.

On the other hand, in the state where the fixing operation is started and the pressure roll 62 is in press-contact with the fixing belt 61 by the retraction mechanism, the entire pressure roll 62, to which the rotational driving force is transmitted by the above-described drive mechanism, rotates the fixing belt 61 to follow the pressure roll 62.

<Description of IH>

Next, the IH 63 that applies the alternating magnetic field to the conductive heat generation layer 612 of the fixing belt 61 to perform the electromagnetic induction heating will be described.

Figure 9:
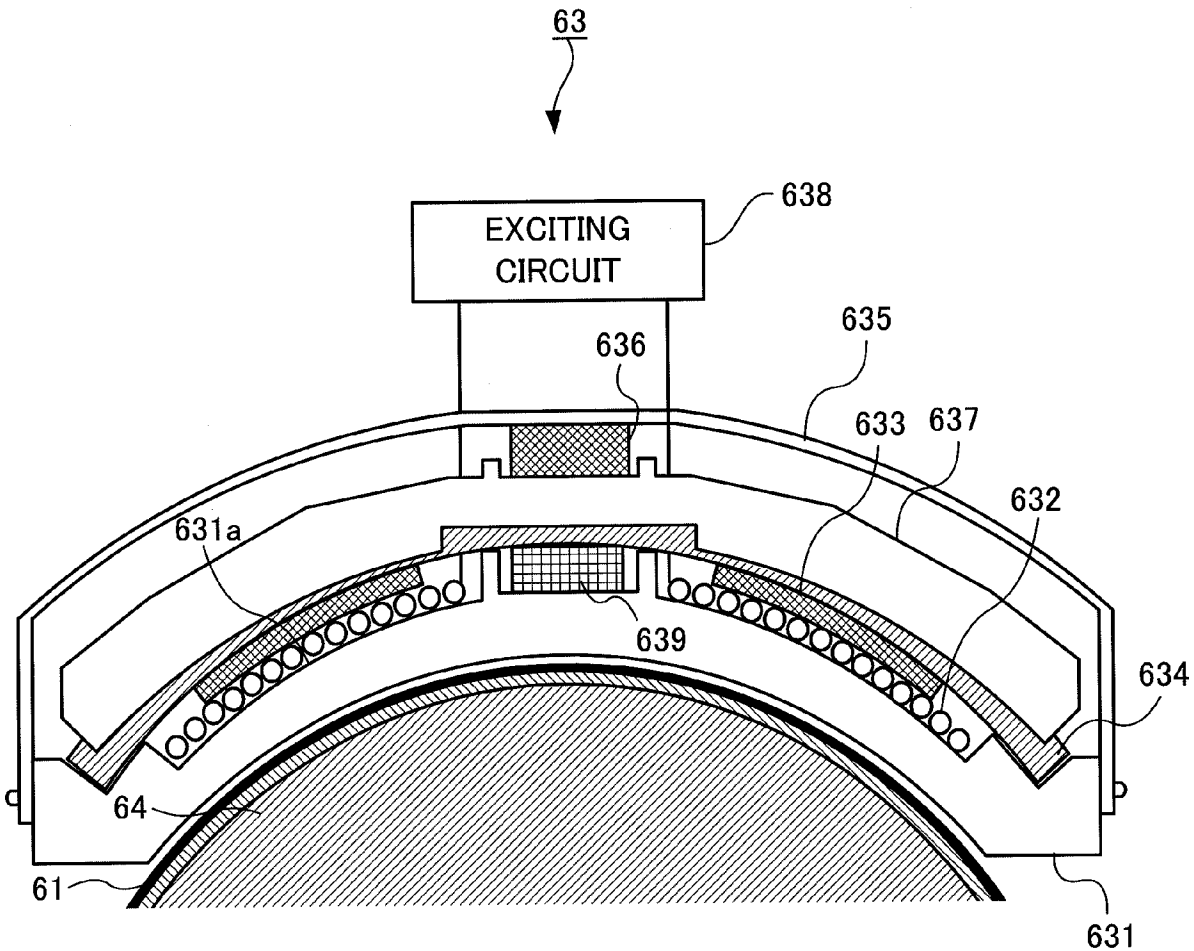
FIG. 9 is a cross-sectional view for illustrating a configuration of an induction heater (IH)

FIG. 9 is a cross-sectional view for illustrating the configuration of the IH 63 in the first exemplary embodiment. As shown in FIG. 9, the IH 63 includes: a support body 631 configured with a non-magnetic material, such as a heat-resistant resin; an energized coil 632 that generates the alternating magnetic field; an elastic support member 633 configured with an elastic material, such as silicone rubber, to secure the energized coil 632 onto the support body 631; and plural magnetic cores 634 arranged along the width direction of the fixing belt 61 to form magnetic paths of the alternating magnetic field generated by the energized coil 632. The IH 63 further includes: plural adjuster magnetic cores 639 arranged along the width direction of the fixing belt 61 to make the alternating magnetic field uniform, which has been generated by the energized coil 632, in the longitudinal direction of the support body 631; magnetic core holding members 637 that hold and cover the magnetic cores 634 from above; a pressurizing member 636, which is configured with an elastic material, such as silicone rubber, to pressurize the magnetic cores 634 toward the support body 631 with the magnetic core holding members 637 interposed therebetween; a shield 635 that shields the magnetic field and suppresses leakage thereof to the outside; and an exciting circuit 638 that supplies an alternating current to the energized coil 632.

The support body 631 is configured with a heat-resistant non-magnetic material, for example, a heat-resistant glass, a polycarbonate, a heat-resistant resin such as a PPS (polyphenylene sulfide), or a heat-resistant resin made by mixing a glass fiber into any of these materials. The cross-section of the support body 631 is formed to have a shape curved along a surface shape of the fixing belt 61, and a support surface 631*a* of the support body 631, which supports the energized coil 632, is formed to maintain a gap of a predetermined size (for example, from about 0.5 to 2 mm) with a surface of the fixing belt 61.

The energized coil 632 is configured by winding a litz wire into a hollow oval, elliptical or rectangular-shaped closed loop, the litz wire being formed by bundling, for example, 90 copper wire materials having a diameter of, for example, about 0.17 mm and insulated with each other. The alternating current of a predetermined frequency is supplied from the exciting circuit 638 to the energized coil 632, thereby generating the alternating magnetic field centering on the litz wire wound into the closed loop around the energized coil 638. The frequency of the alternating current supplied from the exciting circuit 638 to the energized coil 632 ranges from about 20 to about 100 kHz generated by a general power supply that is widely used.

The elastic support member 633 is a sheet-like member configured with an elastic material such as silicone rubber and fluorine rubber. The elastic support member 633 is set to press the energized coil 632 against the support body 631 so that the energized coil 632 is secured to the support surface 631*a* of the support body 631 in intimate contact.

For the magnetic cores 634, an arc-shaped ferromagnetic body configured with an oxide or an alloy material of high magnetic permeability, such as fired ferrite, a ferrite resin, permalloy, a temperature sensitive magnetic alloy and so forth, is used. The magnetic cores 634 directs the magnetic field lines (magnetic flux) due to the alternating magnetic field generated by the energized coil 632 to the inside thereof, and form a path of magnetic field lines (closed magnetic path) which proceeds from the magnetic cores 634 across the fixing belt 61 and returns to the magnetic cores 634. Consequently, the magnetic field lines H of the alternating magnetic field generated by the energized coil 632 are concentrated in a region facing the magnetic cores 634 of the fixing belt 61.

Each of the magnetic core holding members 637 is made of a non-magnetic material such as SUS, a resin, and so forth and holds each of the magnetic cores 634 so as to cover thereof partially or entirely.

As the adjuster magnetic cores 639, a rectangular (block-like) ferromagnetic body configured with a material of high magnetic permeability, such as fired ferrite, a ferrite resin, and so forth, is used. The adjuster magnetic cores 639 make the irregularity of the alternating magnetic field, which is generated by the magnetic cores 634, in the longitudinal direction of the support body 631 (namely, the width direction of the fixing belt 61) even, thereby reducing the temperature variation (temperature fluctuation, temperature ripple) in the width direction of the fixing belt 61.

In this manner, the IH 63 produces magnetic field lines H across the thickness direction of the fixing belt 61 to generate an eddy current I in the conductive heat generation layer 612 of the fixing belt 61 in proportion to an amount of variation in the number of magnetic field lines H (magnetic flux density) per unit area. Thereby, the IH 63 generates Joule heat W, which is a product of the specific resistance R of the conductive heat generation layer 612 and the square of the eddy current I ($W=I^2R$), in the conductive heat generation layer 612 to heat the fixing belt 61.

<Description of Function of Elastic Member>

Next, the function of the elastic member 64 disposed inside the fixing belt 61 will be described.

As described above, the fixing device 60 of the first exemplary embodiment includes the retraction mechanism that causes the roll main body portion 62A of the pressure roll 62 to be in contact with or separated from the fixing belt 61. When the operation of heating the fixing belt 61 up to the temperature enabling fixing by the IH 63 (warm-up operation) is performed before starting the fixing operation, the roll main body portion 62A of the pressure roll 62 is set to a position separated from the fixing belt 61 by the retraction mechanism. Thus, a state is produced where an outflow of heat from the fixing belt 61 having a small heat capacity to the pressure roll 62 hardly occurs. Accordingly, the fixing belt 61 is heated with efficiency, and the time required to heat the fixing belt 61 up to the temperature enabling fixing (hereinafter, referred to as "warm-up time") is reduced. In addition, during the warm-up operation, the power transmission portions 62B and 62C of the pressure roll 62 rotate the fixing belt 61 to follow the pressure roll 62, thereby the temperature of the fixing belt 61 in the rotation direction may be uniform.

When the fixing belt 61 is heated to a predetermined temperature, which is in the vicinity of and lower than the temperature enabling fixing, by the warm-up operation, the pressure roll 62 is brought into press-contact with the fixing belt 61 by the retraction mechanism. Consequently, the nip portion N is formed between the fixing belt 61 and the pressure roll 62 by the elastic forces of both of the elastic member 64 arranged inside the fixing belt 61 across the entire width thereof and the roll main body portion 62A of the pressure roll 62. By forming the nip portion N and heating the fixing belt 61 to reach the temperature enabling fixing, the sheet P is transported to the nip portion N to start the fixing operation.

Figure 10A:
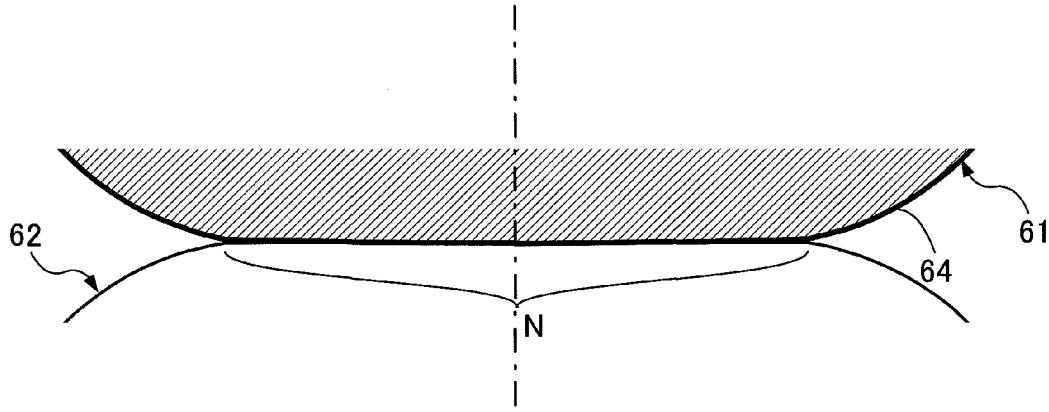
FIGS. 10A and 10B illustrate a state of the fixing belt in a region vicinity of a nip portion.
Figure 10B:
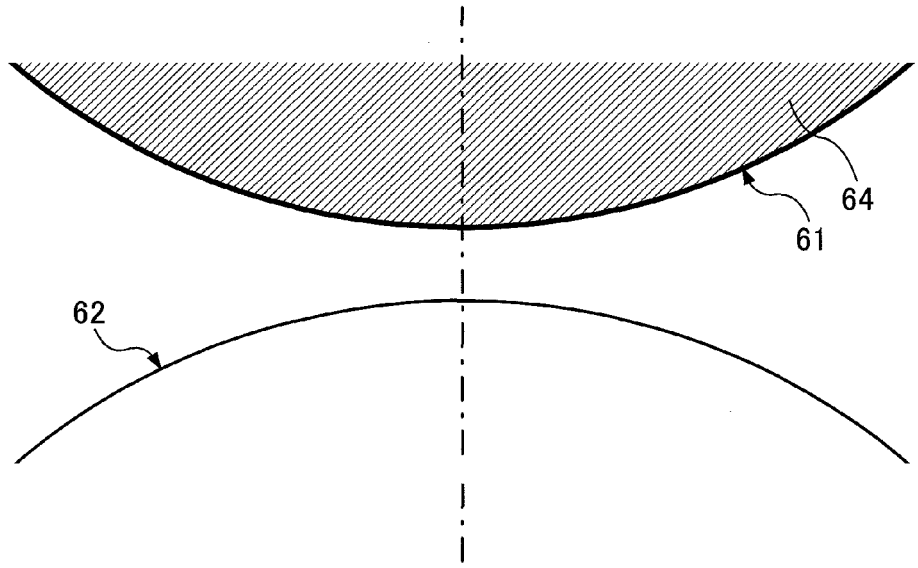

FIGS. 10A and 10B illustrate the state of the fixing belt 61 in a region vicinity of the nip portion N. FIG. 10A illustrates the case where the pressure roll 62 is in press-contact with the fixing belt 61, and FIG. 10B illustrates the case where the roll main body portion 62A of the pressure roll 62 is separated from the fixing belt 61.

As shown in FIG. 10A, during the fixing operation, the pressure roll 62 is arranged in press-contact with the fixing belt 61. Accordingly, in the nip portion N, a predetermined nip pressure is provided by the pressure roll 62 that presses, while elastically deforming, the elastic member 64 with the fixing belt 61 interposed therebetween and the elastic member 64 that elastically deforms by the pressing force from the pressure roll 62.

In this manner, when the pressure roll 62 is arranged in press-contact with the fixing belt 61, the elastic member 64 receives the pressing force from the pressure roll 62 and elastically deforms, thus forming the nip portion N. The nip pressure in this case is set to the predetermined pressure with stability by both pressure roll 62 that elastically deforms and elastic member 64 that also elastically deforms.

On the other hand, as shown in FIG. 10B, during the warm-up operation, the roll main body portion 62A of the pressure roll 62 is arranged to be separated from the fixing belt 61 by the retraction mechanism. At that time, the form of the fixing belt 61 and the elastic member 64 is restored for the entire circumference of the fixing belt 61.

As described above, during the warm-up operation, the roll main body portion 62A of the pressure roll 62 is separated from the fixing belt 61 by the retraction mechanism, thereby providing a state where the outflow of heat from the fixing belt 61 to the pressure roll 62 does not occur at the outside of the fixing belt 61. Accordingly, the configuration that reduces the warm-up time for heating the fixing belt 61 up to the temperature enabling fixing is achieved. The fixing belt 61 is configured to be rotated by the power transmission portions 62B and 62C of the pressure roll 62 to follow the pressure roll 62 at that time, thereby the temperature of the fixing belt 61 in the rotation direction may be uniform during the warm-up operation.

As has been described, in the fixing device 60 of the first exemplary embodiment, the drive mechanism, which transmits the driving force to the pressure roll 62 in both the state where the pressure roll 62 is brought into press-contact with the fixing belt 61 and the state where the roll main body portion 62A of the pressure roll 62 is separated from the fixing belt 61 by the retraction mechanism, thus rotating the fixing belt 61 to follow the pressure roll 62. This makes the configuration for rotating and driving the fixing belt 61 simpler, reduces the cost of the fixing device 60, and downsizes the fixing device 60.

<Description of Operation Control for Image Forming Processing>

Subsequently, flow of the image forming operation will be described.

Figure 11:
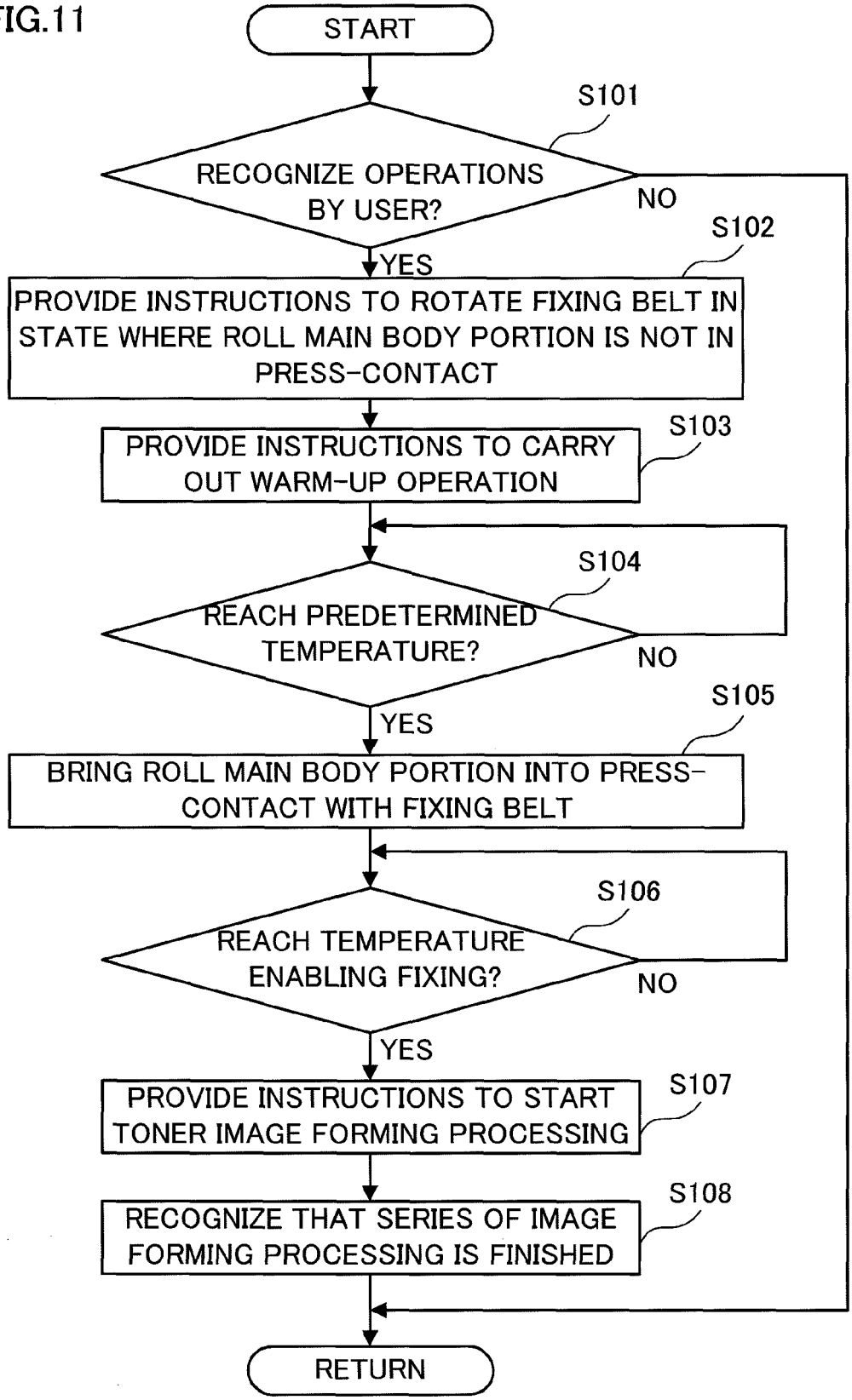
FIG. 11 is a flowchart for illustrating an example of contents of image forming processing performed by a main controller.

FIG. 11 is a flowchart for illustrating an example of contents of the image forming processing performed by the main controller 31.

As shown in FIG. 11, based on a signal from the image reader 33, the UI 35 or the communication portion 32, the main controller 31 monitors operations performed by a user, such as placing a document on the image reader 33 (hereinafter, referred to as "operations by the user"), before providing instructions for image forming (step 101). In the case where the main controller 31 recognizes the operations by the user (Yes at step 101), the main controller 31 provides instructions to the fixing device 60 for turning the drive motor 90 (refer to FIG. 2) on to rotate the fixing belt 61 in the state where the roll main body portion 62A of the pressure roll 62 is not in press-contact with the fixing belt 61 by the retraction mechanism (step 102). Thereafter, the main controller 31 provides instructions for carrying out the warm-up operation (step 103).

At this stage, since the roll main body portion 62A of the pressure roll 62 is separated from the fixing belt 61, the state where the outflow of heat from the fixing belt 61 to the pressure roll 62 does not occur at the outside of the fixing belt 61 is provided. Consequently, the outflow of heat from the fixing belt 61 with the small heat capacity is suppressed, and thus the warm-up time for heating the fixing belt 61 up to the temperature enabling fixing is reduced. In this case, the fixing belt 61 is rotated by the drive mechanism which is the same as in the state where the roll main body portion 62A of the pressure roll 62 is in press-contact with the fixing belt 61.

On the other hand, in the case where the main controller 31 does not recognize the operations by the user (No at step 101), the main controller 31 continues to monitor the operations by the user (step 101).

When the fixing belt 61 is heated to reach a predetermined temperature, which is in the vicinity of and lower than the temperature enabling fixing, by the warm-up operation (Yes at step 104), the main controller 31 brings the roll main body portion 62A of the pressure roll 62 into press-contact with the fixing belt 61 by the retraction mechanism (step 105). When the fixing belt 61, with which the pressure roll 62 is in press-contact, is heated to reach the temperature enabling fixing (Yes at step 106), the main controller 31 provides instructions to the image forming portion 10 to start the toner image forming processing (step 107).

At this stage, since the pressure roll 62 is arranged to be in press-contact with the fixing belt 61, the nip portion N with the predetermined nip pressure is formed between the fixing belt 61 and the pressure roll 62 by the elastic forces of both of the elastic member 64 and the pressure roll 62. The pressure roll 62 is rotated by the drive mechanism which is the same as in the state where the roll main body portion 62A of the pressure roll 62 is separated from the fixing belt 61.

When the main controller 31 recognizes that a series of image forming processing is finished (step 108), the main controller 31 returns to step 101 and monitors the operations by the user.

<Description of Other Configuration of Power Transmission Portion Provided to Pressure Roll>

With respect to the power transmission portions 62B and 62C provided to the pressure roll 62, a configuration other than that shown in FIGS. 6A and 6B will be described. With reference to FIGS. 6A and 6B, the configuration has been described, in which the power transmission portions 62B and 62C are supported by the power transmission support portions 62J and 62K that are integrally formed with the roll main body portion 62A. Here, a configuration will be described, in which the power transmission portions 62B and 62C are formed separately from the roll main body portion 62A.

Figure 12A:
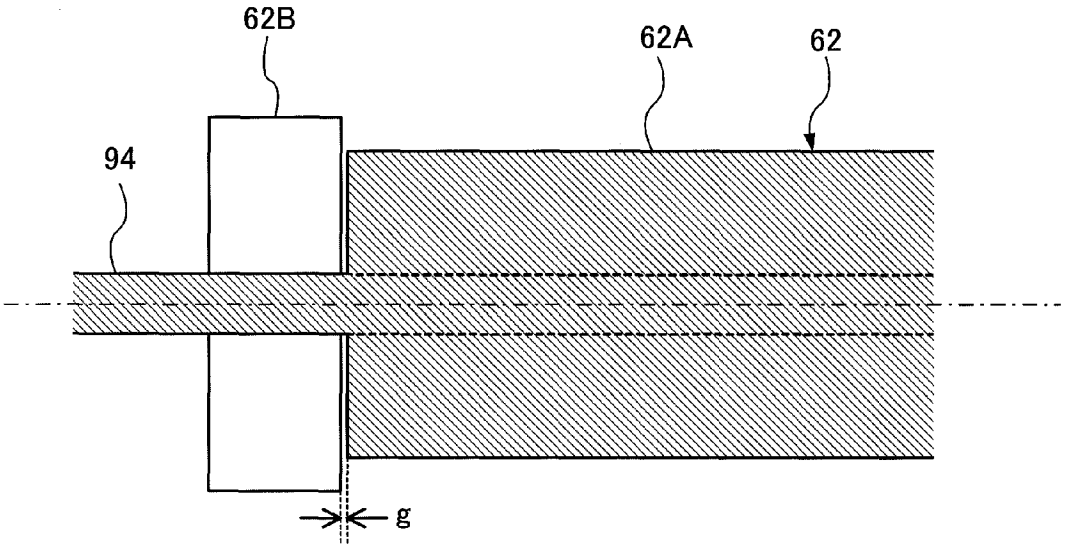
FIGS. 12A and 12B specifically illustrate another configuration of power transmission portions of the pressure roll.
Figure 12B:
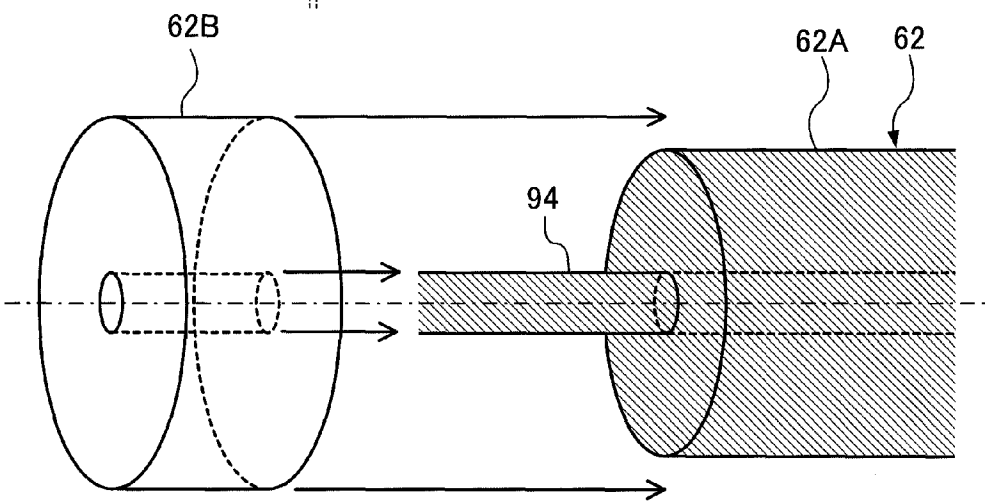

FIGS. 12A and 12B specifically illustrate the other configuration of the power transmission portions 62B and 62C of the pressure roll 62. FIG. 12A shows a cross-sectional configuration of the power transmission portions 62B and 62C, and FIG. 12B is a perspective view showing an assembly configuration of the power transmission portions 62B and 62C. It should be noted that FIGS. 12A and 12B only show the power transmission portion 62B, which is on one end portion side of the pressure roll 62, however, the power transmission portion 62C on the other end portion side is configured in the same manner.

As shown in FIGS. 12A and 12B, the power transmission portions 62B and 62C are configured separately from the roll main body portion 62A and fitted over the rotating shaft 94 to be attached thereto. And as shown in FIG. 12A, the power transmission portions 62B and 62C are arranged adjacent to the roll main body portion 62A with a gap g in the direction of the rotating shaft 94 interposed therebetween.

Consequently, when the pressure roll 62 is arranged in press-contact with the fixing belt 61, the power transmission portions 62B and 62C having been elastically deformed are brought into press-contact in the direction of the rotating shaft 94 with the roll main body portion 62A of the pressure roll 62 in a region where the power transmission portions 62B and 62C are adjacent to the roll main body portion 62A, the roll main body portion 62A forming the nip portion N while elastically deforming, thereby suppressing non-uniform nip pressure at both end portions of the roll main body portion 62A. In other words, by forming the power transmission portions 62B and 62C and the roll main body portion 62A separately, the elastic deformation of the power transmission portions 62B and 62C has little effect on the roll main body portion 62A. Moreover, the gap g between the power transmission portions 62B and 62C and the roll main body portion 62A maintains the elastically deformed power transmission portions 62B and 62C and the elastically deformed roll main body portion 62A not to be in contact with each other, and thereby the elastic deformation of the power transmission portions 62B and 62C further has little effect on the roll main body portion 62A.

Thus, by the configuration of the power transmission portions 62B and 62C shown in FIGS. 12A and 12B, uniformity of the nip pressure at both end portions of the roll main body portion 62A is ensured.

It should be noted that the first exemplary embodiment shows the case of employing the elastic member 64 which is provided all over the inside of the fixing belt 61, however, the elastic member 64 may be provided to a partial region inside the fixing belt 61 that is pressed by the pressure roll 62 or the power transmission portions 62B and 62C.

It should also be noted that the image forming apparatus of the electrophotographic system is taken as an example in the first exemplary embodiment, however, the image forming apparatus may employ an ink jet system.

As described so far, during the operation of heating the fixing belt 61 up to the temperature enabling fixing (warm-up operation), the fixing device 60 of the first exemplary embodiment provides the state where the outflow of heat from the fixing belt 61 to the pressure roll 62 does not occur at the outside of the fixing belt 61 by arranging the roll main body portion 62A of the pressure roll 62 to be separated from the fixing belt 61. Further, the fixing device 60 of the first exemplary embodiment includes the drive mechanism that transmits the driving force to the pressure roll 62 in both the state where the pressure roll 62 is brought into press-contact with the fixing belt 61 and the state where the roll main body portion 62A of the pressure roll 62 is separated from the fixing belt 61, thus rotating the fixing belt 61 to follow the pressure roll 62. Accordingly, as well as the time required to heat the fixing belt 61 up to the temperature enabling fixing (warm-up time) is reduced, the temperature of the fixing belt 61 in the rotation direction may be uniform during the warm-up operation. Furthermore, the configuration for rotating and driving the fixing belt 61 is made simpler to reduce the cost of the fixing device 60 and downsize the fixing device 60.

SECOND EXEMPLARY EMBODIMENT

In the first exemplary embodiment, the configuration in which the fixing belt 61 with the elastic member 64 arranged across the entire width of the fixing belt 61 is rotated to follow the pressure roll 62 in the state that the pressure roll 62 is arranged to be brought into press-contact with the fixing belt 61 by the retraction mechanism and in the state that the roll main body portion 62A of the pressure roll 62 is arranged separated from the fixing belt 61 is described. In a second exemplary embodiment, a configuration in which the fixing belt 61 with the elastic member 64 to be close to an inner circumferential surface of the fixing belt 61 is rotated to follow the pressure roll 62 by using the pressure roll 62 provided the drive mechanism similar to that of the first exemplary embodiment will be described. Note that the same configurations are denoted by the same reference signs and are not described in detail.

<Description of Configuration of Fixing Unit>

Next, a description will be given of the fixing device 160 in the second exemplary embodiment.

Figure 13:
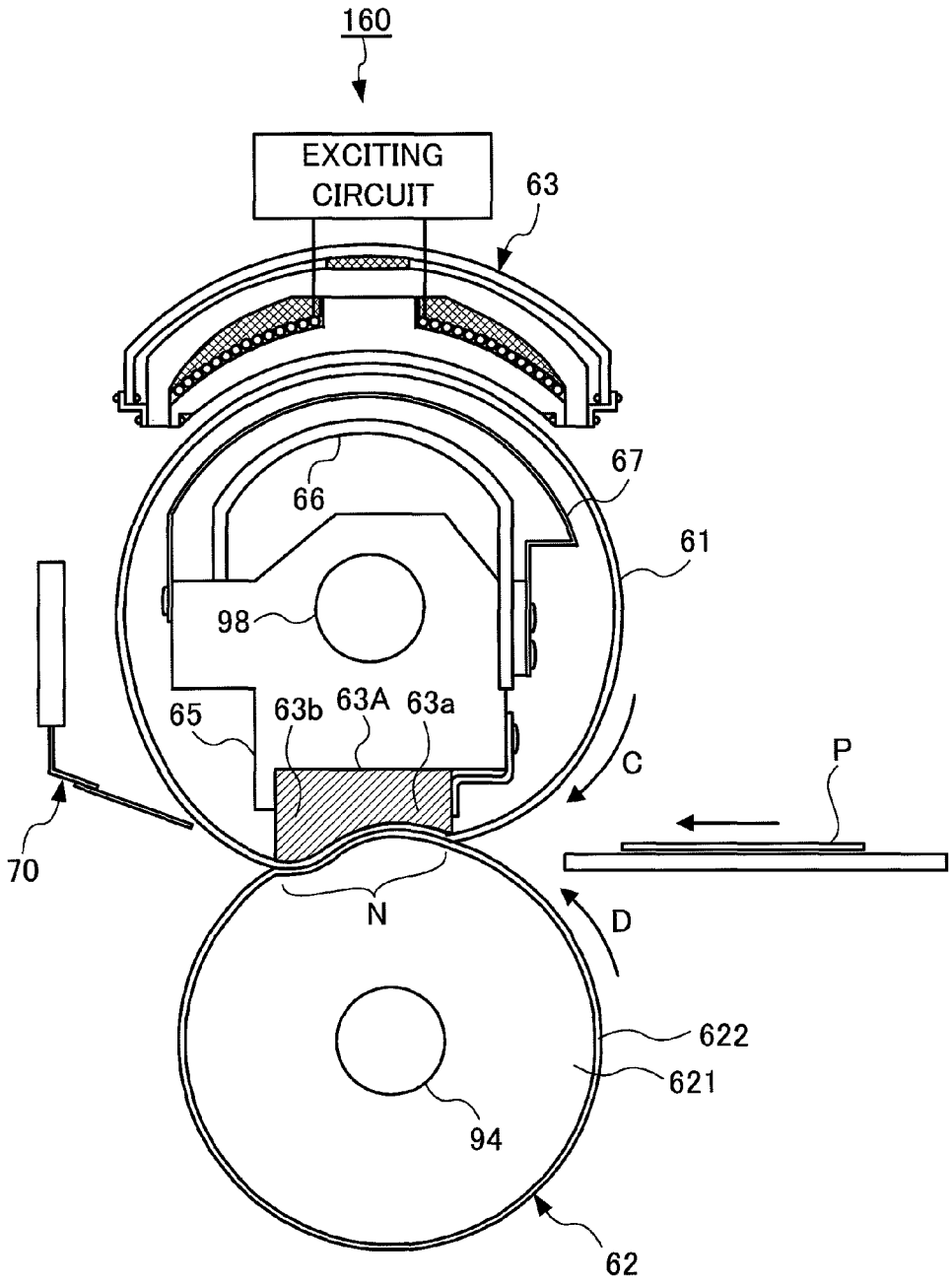
FIG. 13 is a cross-sectional layer configuration view of a fixing device.

FIG. 13 is a cross-sectional layer configuration view of the fixing device 160 of the second exemplary embodiment. As shown in FIG. 13, the fixing device 160 includes: an induction heating (IH) heater 63 as an example of a heating member and a magnetic field generating member that generates an AC (alternate-current) magnetic field; a fixing belt 61 as an example of a fixing member that is subjected to electromagnetic induction heating by the IH heater 63, and thereby fixes a toner image; a pressure roll 62 that is arranged so as to face the fixing belt 61; and a pressing pad 63A that is pressed by the pressure roll 62 with the fixing belt 61 therebetween. The fixing belt 61 is rotatably supported with respect to a holder 65. In addition, the pressing pad 63A is arranged across the entire width of the fixing belt 61.

The fixing device 160 further includes: the holder 65 that supports a constituent member such as the pressing pad 63A and the like; a temperature-sensitive magnetic member 67 that forms a magnetic path by inducing the AC magnetic field generated at the IH heater 63; an induction member 66 that induces magnetic field lines passing through the temperature-sensitive magnetic member 67; and a peeling assisting member 70 that assists peeling of the sheet P from the fixing belt 61.

<Description of Fixing Belt>

The fixing belt 61 is similar to that of the first exemplary embodiment. As shown in FIG. 4, as for the cross-sectional layer configuration, the fixing belt 61 is a belt member having a multi-layer structure including a base layer 611, a conductive heat generation layer 612 and an elastic layer 614.

<Description of Pressing Pad>

The pressing pad 63A is formed of an elastic material such as a silicone rubber or fluorine-contained rubber, and is supported by the holder 65 at a position facing the pressure roll 62. Then, the pressing pad 63A is arranged in a state of being pressed by the pressure roll 62 with the fixing belt 61 therebetween, and forms the nip portion N with the pressure roll 62.

In addition, the pressing pad 63A has different nip pressures set for a pre-nip region 63*a* on the sheet entering side of the nip portion N (upstream side in the transport direction of the sheet P) and a peeling nip region 63*b* on the sheet exit side of the nip portion N (downstream side in the transport direction of the sheet P), respectively. Specifically, a surface of the pre-nip region 63*a* at the pressure roll 62 side is formed into a circular arc shape approximately corresponding with the outer circumferential surface of the pressure roll 62, and the nip portion N, which is uniform and wide, is formed. Moreover, a surface of the peeling nip region 63*b* at the pressure roll 62 side is formed into a shape so as to be locally pressed with a larger nip pressure from the surface of the pressure roll 62 in order that a curvature radius of the fixing belt 61 passing through the peeling nip region 63*b* may be small. Thereby, a curl (down curl) in a direction in which the sheet P is separated from the surface of the fixing belt 61 is formed on the sheet P passing through the peeling nip region 63*b*, thereby promoting the peeling of the sheet P from the surface of the fixing belt 61.

<Description of Temperature-sensitive Magnetic Member>

Next, the temperature-sensitive magnetic member 67 is formed into a circular arc shape corresponding with an inner circumferential surface of the fixing belt 61 and is arranged to be close to, but not to be in contact with the inner circumferential surface of the fixing belt 61 so as to have a predetermined gap (0.5 to 1.5 mm, for example) with the inner circumferential surface of the fixing belt 61. The reason for arranging the temperature-sensitive magnetic member 67 so as to be close to the fixing belt 61 is to achieve a configuration in which the temperature of the temperature-sensitive magnetic member 67 changes in accordance with the temperature of the fixing belt 61, that is, the temperature of the temperature-sensitive magnetic member 67 becomes substantially equal to the temperature of the fixing belt 61. In addition, the reason for arranging the temperature-sensitive magnetic member 67 so as not to be in contact with the fixing belt 61 is to suppress heat of the fixing belt 61 flowing into the temperature-sensitive magnetic member 67 when the fixing belt 61 is self-heated up to the fixation setting temperature after a main switch of the image forming apparatus 1 is turned on, and thereby to achieve shortening of the warm-up time.

Moreover, the temperature-sensitive magnetic member 67 is formed of a material whose "permeability change start temperature" (refer to later part of the description) at which the permeability of the magnetic properties drastically changes is not less than the fixation setting temperature at which each color toner image starts melting, and whose permeability change start temperature is also set within a temperature range lower than the heat-resistant temperatures of the elastic layer 613 and the surface release layer 614 of the fixing belt 61. Specifically, the temperature-sensitive magnetic member 67 is formed of a material having a property ("temperature-sensitive magnetic property") that reversibly changes between the ferromagnetic property and the non-magnetic property (paramagnetic property) in a temperature range including the fixation setting temperature. Thus, the temperature-sensitive magnetic member 67 functions as a magnetic path forming member that forms a magnetic path in the temperature-sensitive magnetic member 67 within a temperature range not greater than the permeability change start temperature, where the temperature-sensitive magnetic member 67 has the ferromagnetic property. Further, within the temperature range not greater than the permeability change start temperature, the temperature-sensitive magnetic member 67 induces magnetic field lines generated by the IH heater 63 and going through the fixing belt 61 to the inside thereof, and forms a magnetic path so that the magnetic field lines may pass through the inside of the temperature-sensitive magnetic member 67. Thereby, the temperature-sensitive magnetic member 67 forms a closed magnetic path that internally wraps the fixing belt 61 and an excitation coil 82 (refer to FIG. 6) of the IH heater 63. Meanwhile, within a temperature range exceeding the permeability change start temperature, the temperature-sensitive magnetic member 67 causes the magnetic field lines generated by the IH heater 63 and going through the fixing belt 61 to go therethrough so as to run across the temperature-sensitive magnetic member 67 in the thickness direction of the temperature-sensitive magnetic member 67. Then, the magnetic field lines generated by the IH heater 63 and going through the fixing belt 61 form a magnetic path in which the magnetic field lines go through the temperature-sensitive magnetic member 67, pass through the inside of the induction member 66, and then return to the IH heater 63.

Note that, the "permeability change start temperature" herein refers to a temperature at which a permeability (permeability measured by JIS C2531, for example) starts decreasing continuously and refers to a temperature point at which the amount of the magnetic flux (the number of magnetic field lines) going through a member such as the temperature-sensitive magnetic member 67 starts to change, for example. Accordingly, the permeability change start temperature is a temperature close to the Curie point, which is a temperature at which the magnetic property is lost, but is a temperature with a concept different from the Curie point.

Examples of the material of the temperature-sensitive magnetic member 67 include a binary component Fe—Ni alloy or a ternary component Fe—Ni—Cr alloy such as permalloys, temperature-sensitive magnetic alloy or the like whose permeability change start temperature is set within a range of 140 degrees C. (the fixation setting temperature) to 240 degrees C.

For example, the permeability change start temperature may be set around 225 degrees C. by setting the ratios of Fe and Ni at approximately 64% and 36% (atom number ratio), respectively, in a binary temperature-sensitive magnetic alloy of Fe—Ni. The aforementioned metal alloys or the like including the permalloy and the temperature-sensitive magnetic alloy are suitable for the temperature-sensitive magnetic member 67 since they are excellent in formability and workability, and a high heat conductivity as well as less expensive costs. Another example of the material includes a metal alloy made of Fe, Ni, Si, B, Nb, Cu, Zr, Co, Cr, V, Mn, Mo or the like.

In addition, the temperature-sensitive magnetic member 67 is formed with a thickness smaller than the skin depth δ (refer to the formula (1) described above) with respect to the AC magnetic field (magnetic field lines) generated by the IH heater 63. Specifically, a thickness of approximately 50 to 300 μm is set when a Fe—Ni alloy is used as the material, for example. Note that, the configuration and the function of the temperature-sensitive magnetic member 67 will be described later in detail.

<Description of Holder>

The holder 65 that supports the pressing pad 63A is formed of a material having a high rigidity so that the amount of deflection in a state where the pressing pad 63A receives pressing force from the pressure roll 62 may be a certain amount or less. In this manner, the amount of pressure (nip pressure N) at the nip portion N in the longitudinal direction is kept uniform. Moreover, since the fixing device 160 of the second exemplary embodiments employs a configuration in which the fixing belt 61 is self-heated by use of electromagnetic induction, the holder 65 is made of a material that provides no influence or hardly provides influence on an induction magnetic field, and that is not influenced or is hardly influenced by the induction magnetic field. For example, a heat-resistant resin such as glass mixed PPS (polyphenylene sulfide), or a paramagnetic metal material such as Al, Cu or Ag is used.

Support shaft 98 is formed at the both end portion of the holder 65, and the support shaft 98 is supported by the support body 69 (refer to FIG. 2). Thereby, the pressing pad 63A, the holder 65, the temperature-sensitive magnetic member 67, the induction member 66 and the like, which are arranged inside of the fixing belt 61, are fixed to the support body 69. On the other hand, the fixing belt 61 rotatably supported with respect to the holder 65 is also rotatably supported with respect to the support body. In this point, the support shaft 98 has a similar function to that of the rotating shaft 99 of the elastic member 64 arranged inside the fixing belt 61 of the first exemplary embodiment.

<Description of Induction Member>

The induction member 66 is formed into a circular arc shape corresponding with the inner circumferential surface of the temperature-sensitive magnetic member 67 and is arranged so as not to be in contact with the inner circumferential surface of the temperature-sensitive magnetic member 67. Here, the induction member 66 has a gap set in advance (1.0 to 5.0 mm, for example) with the inner circumferential surface of the temperature-sensitive magnetic member 67. The induction member 66 is formed of, for example, a non-magnetic metal such as Ag, Cu and Al having a relatively small specific resistance. When the temperature of temperature-sensitive magnetic member 67 increases to a temperature not less than the permeability change start temperature, the induction member 66 induces an AC magnetic field (magnetic field lines) generated by the IH heater 63 and thereby forms a state where an eddy current I is more easily generated in comparison with the conductive heat generating layer 612 of the fixing belt 61. For this reason, the thickness of the induction member 66 is formed to be a predetermined thickness (1.0 mm, for example) sufficiently larger than the skin depth δ (refer to the aforementioned formula (1)) so as to allow the eddy current I to easily flow therethrough.

<Description of Pressure Roll>

The pressure roll 62 of the second exemplary embodiment has the same configuration of that of the first exemplary embodiment. As shown in FIG. 2, the pressure roll 62 is configured with the roll main body portion 62A and the power transmission portions 62B and 62C formed in both end portions of the roll main body portion 62A (regions outside of the maximum sheet passing region Rmax). In addition, the pressure roll 62 is provided the retract mechanism (contact/retraction mechanism, moving unit) and the drive mechanism (refer to FIG. 2) similar to the first exemplary embodiment. The pressure roll 62 is brought into press-contact (contacts while pressing) with the fixing belt 61 by the retraction mechanism in accordance with the start of the fixing operation of the fixing device 160. Accordingly, at the time of fixing operation, the fixing belt 61 is rotated to follow the pressure roll 62 that receives the rotational driving force from the drive motor 90 (refer to FIG. 2). Before the fixing operation, the roll main body portion 62A of the pressure roll 62 is maintained at a state in which the roll main body portion 62A is separated from the fixing belt 61. The fixing belt 61 is rotated by the power transmission portions 62B and 62C in that state, and the warm-up operation to heat the fixing belt 61 until reaching a temperature capable of performing fixing by the IH heater 63 is performed.

<Description of Function of Pressure Roll>

In the fixing device 160 of the second exemplary embodiment, as described above, when the operation of heating the fixing belt 61 up to the temperature enabling fixing by the IH 63 (warm-up operation) is performed before starting the fixing operation, the roll main body portion 62A of the pressure roll 62 is set to a position separated from the fixing belt 61 by the retraction mechanism. Thus, a state is produced where an outflow of heat from the fixing belt 61 having a small heat capacity to the pressure roll 62 hardly occurs. Accordingly, the fixing belt 61 is heated with efficiency, and the time required to heat the fixing belt 61 up to the temperature enabling fixing (hereinafter, referred to as "warm-up time") is reduced. In addition, during the warm-up operation, the power transmission portions 62B and 62C of the pressure roll 62 rotate the fixing belt 61 to follow the pressure roll 62, thereby the temperature of the fixing belt 61 in the rotation direction may be uniform.

On the other hand, when the fixing belt 61 is heated to a predetermined temperature, which is in the vicinity of and lower than the temperature enabling fixing, by the warm-up operation, the pressure roll 62 is brought into press-contact with the fixing belt 61 by the retraction mechanism. Consequently, the nip portion N is formed between the fixing belt 61 and the pressure roll 62 by the elastic forces of both of the pressing pad 63A arranged inside the fixing belt 61 across the entire width thereof and the roll main body portion 62A of the pressure roll 62. By forming the nip portion N and heating the fixing belt 61 to reach the temperature enabling fixing, the sheet P is transported to the nip portion N to start the fixing operation.

As described so far, during the operation of heating the fixing belt 61 up to the temperature enabling fixing (warm-up operation), the fixing device 160 of the second exemplary embodiment provides the state where the outflow of heat from the fixing belt 61 to the pressure roll 62 does not occur at the outside of the fixing belt 61 by arranging the roll main body portion 62A of the pressure roll 62 to be separated from the fixing belt 61. Further, the fixing device 160 of the second exemplary embodiment includes the drive mechanism that transmits the driving force to the pressure roll 62 in both the state where the pressure roll 62 is brought into press-contact with the fixing belt 61 and the state where the roll main body portion 62A of the pressure roll 62 is separated from the fixing belt 61, thus rotating the fixing belt 61 to follow the pressure roll 62. Accordingly, as well as the time required to heat the fixing belt 61 up to the temperature enabling fixing (warm-up time) is reduced, the temperature of the fixing belt 61 in the rotation direction may be uniform during the warm-up operation. Furthermore, the configuration for rotating and driving the fixing belt 61 is made simpler to reduce the cost of the fixing device 160 and downsize the fixing device 160.

THIRD EXEMPLARY EMBODIMENT

In a third exemplary embodiment, a configuration in which the fixing belt 61 arranged a sheet-like heat generation member 68 to be contact with an inner circumferential surface of the fixing belt 61 is rotated to follow the pressure roll 62 by using the pressure roll 62 provided the drive mechanism similar to that of the first exemplary embodiment will be described. Note that the same configurations are denoted by the same reference signs and are not described in detail.

<Description of Configuration of Fixing Unit>

Next, a description will be given of the fixing device 260 in the third exemplary embodiment.

Figure 14:
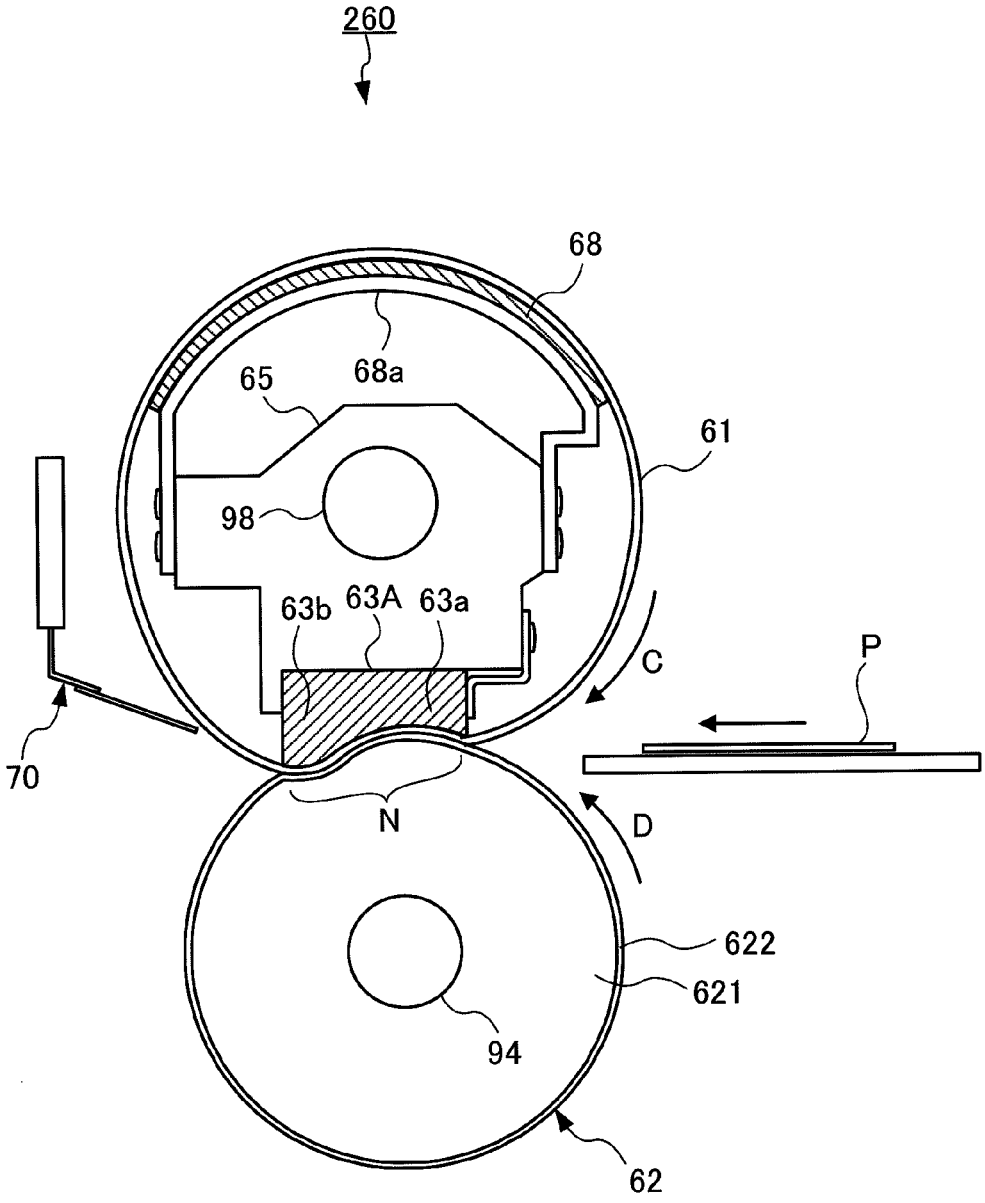
FIG. 14 is a cross-sectional layer configuration view of a fixing device.

FIG. 14 is a cross-sectional layer configuration view of the fixing device 260 of the third exemplary embodiment. As shown in FIG. 14, the fixing device 260 includes: the sheet-like heat generation member 68 as an example of a heating member; a fixing belt 61 as an example of a fixing member that is arranged to be contact with the sheet-like heat generation member 68 and heated by the sheet-like heat generation member 68, and thereby fixes a toner image; a pressure roll 62 that is arranged so as to face the fixing belt 61; and a pressing pad 63A that is pressed by the pressure roll 62 with the fixing belt 61 therebetween. The fixing belt 61 is rotatably supported with respect to a holder 65. In addition, the pressing pad 63A is arranged across the entire width of the fixing belt 61.

The fixing device 260 further includes: the holder 65 that supports a constituent member such as the pressing pad 63A and the like; and the peeling assisting member 70 that assists peeling of the sheet P from the fixing belt 61. The sheet-like heat generation member 68 is supported by the holder 65 with a heat generation member support body 68*a* that supports the sheet-like heat generation member 68.

<Description of Fixing Belt>

The fixing belt 61 is a belt member with a multi-layer structure configured with a base layer, an elastic layer and a surface release layer. The base layer is formed to have, for example, a thickness of from about 30 to about 200 μm, and a heat-resistant resin such as polyimide and the like and a metal such as SUS, aluminum and the like are employed to form the base layer. As the elastic layer, for example, silicone rubber with a thickness of from about 100 to about 600 μm and a JIS-A hardness of from about 10 to about 30 may be used. As the surface release layer, a material having a high release capability with respect to toner may be used. For example, PFA (tetrafluoroethylene/perfluoroalkyl vinyl ether copolymer resin), PTFE (polytetrafluoroethylene), silicone copolymer, or a complex layer including any combination thereof may be used for the surface release layer. Note that, the function of the elastic layer and the surface release layer is similar to that of the first exemplary embodiment.

The fixing belt 61 of the third exemplary embodiment is heated by the heat which is conducted by the contact of the base layer with the sheet-like heat generation member 68.

The sheet-like heat generation member 68 is formed to have a curved shape along with the inner circumferential surface of the fixing belt 61, and arranged across the entire width of the fixing belt 61. The sheet-like heat generation member 68 has a laminated structure in which a resident heat generation layer as an example of a heating body, a heat conduction layer and an insulant layer are laminated on a base formed of an insulator. The base of the sheet-like heat generation member 68 is supported by the heat generation member support body 68*a* and the heat conduction layer is arranged to be surface-contact with the inner circumferential surface of the fixing belt 61, thereby the fixing belt 61 is heated.

Note that any configuration may be employed for the sheet-like heat generation member 68 as long as the sheet-like heat generation member 68 is configured to heat the fixing belt 61 by conducting the heat to the fixing belt 61. The sheet-like heat generation member 68 may be arranged not to be contact with the inner circumferential surface of the fixing belt 61, thereby the fixing belt 61.

<Description of Pressing Pad and Holder>

The pressing pad 63A and the holder 65 are configured similar to those of the second exemplary embodiment. Support shaft 98 is formed at the both end portion of the holder 65, and the support shaft 98 is supported by the support body 69 (refer to FIG. 2). Thereby, the sheet-like heat generation member 68, the pressing pad 63A, the holder 65 and the like, which are arranged inside of the fixing belt 61, are fixed to the support body 69. On the other hand, the fixing belt 61 rotatably supported with respect to the holder 65 is also rotatably supported with respect to the support body. In this point, the support shaft 98 has a similar function to that of the rotating shaft 99 of the elastic member 64 arranged inside the fixing belt 61 of the first exemplary embodiment.

<Description of Pressure Roll>

The pressure roll 62 of the third exemplary embodiment has the same configuration of that of the first exemplary embodiment. As shown in FIG. 2, the pressure roll 62 is configured with the roll main body portion 62A and the power transmission portions 62B and 62C formed in both end portions of the roll main body portion 62A (regions outside of the maximum sheet passing region Rmax). In addition, the pressure roll 62 is provided the retract mechanism (contact/retraction mechanism, moving unit) and the drive mechanism (refer to FIG. 2) similar to the first exemplary embodiment. The pressure roll 62 is brought into press-contact (contacts while pressing) with the fixing belt 61 by the retraction mechanism in accordance with the start of the fixing operation of the fixing device 260. Accordingly, at the time of fixing operation, the fixing belt 61 is rotated to follow the pressure roll 62 that receives the rotational driving force from the drive motor 90 (refer to FIG. 2). Before the fixing operation, the roll main body portion 62A of the pressure roll 62 is maintained at a state in which the roll main body portion 62A is separated from the fixing belt 61. The fixing belt 61 is rotated by the power transmission portions 62B and 62C in that state, and the warm-up operation to heat the fixing belt 61 until reaching a temperature capable of performing fixing by the IH heater 63 is performed.

<Description of Function of Pressure Roll>

In the fixing device 260 of the third exemplary embodiment, as described above, when the operation of heating the fixing belt 61 up to the temperature enabling fixing by the sheet-like heat generation member 68 (warm-up operation) is performed before starting the fixing operation, the roll main body portion 62A of the pressure roll 62 is set to a position separated from the fixing belt 61 by the retraction mechanism. Thus, a state is produced where an outflow of heat from the fixing belt 61 having a small heat capacity to the pressure roll 62 hardly occurs. Accordingly, the fixing belt 61 is heated with efficiency, and the time required to heat the fixing belt 61 up to the temperature enabling fixing (hereinafter, referred to as "warm-up time") is reduced. In addition, during the warm-up operation, the power transmission portions 62B and 62C of the pressure roll 62 rotate the fixing belt 61 to follow the pressure roll 62, thereby the temperature of the fixing belt 61 in the rotation direction may be uniform.

On the other hand, when the fixing belt 61 is heated to a predetermined temperature, which is in the vicinity of and lower than the temperature enabling fixing, by the warm-up operation, the pressure roll 62 is brought into press-contact with the fixing belt 61 by the retraction mechanism. Consequently, the nip portion N is formed between the fixing belt 61 and the pressure roll 62 by the elastic forces of both of the pressing pad 63A arranged inside the fixing belt 61 across the entire width thereof and the roll main body portion 62A of the pressure roll 62. By forming the nip portion N and heating the fixing belt 61 to reach the temperature enabling fixing, the sheet P is transported to the nip portion N to start the fixing operation.

As described so far, during the operation of heating the fixing belt 61 up to the temperature enabling fixing (warm-up operation), the fixing device 260 of the third exemplary embodiment provides the state where the outflow of heat from the fixing belt 61 to the pressure roll 62 does not occur at the outside of the fixing belt 61 by arranging the roll main body portion 62A of the pressure roll 62 to be separated from the fixing belt 61. Further, the fixing device 160 of the second exemplary embodiment includes the drive mechanism that transmits the driving force to the pressure roll 62 in both the state where the pressure roll 62 is brought into press-contact with the fixing belt 61 and the state where the roll main body portion 62A of the pressure roll 62 is separated from the fixing belt 61, thus rotating the fixing belt 61 to follow the pressure roll 62. Accordingly, as well as the time required to heat the fixing belt 61 up to the temperature enabling fixing (warm-up time) is reduced, the temperature of the fixing belt 61 in the rotation direction may be uniform during the warm-up operation. Furthermore, the configuration for rotating and driving the fixing belt 61 is made simpler to reduce the cost of the fixing device 260 and downsize the fixing device 160.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a heating member including a heat generation layer that generates heat by electromagnetic induction, and heating a recording medium by electromagnetic induction heating of the heat generation layer; and a pressure member configured to be movable in a direction approaching or away from the heating member, and forming a nip portion with the heating member therebetween, through which the recording medium passes, the pressure member being configured to include: a nip forming portion that forms the nip portion with the heating member therebetween in a state where the pressure member is set at a position in contact with the heating member while pressing the heating member; and a driving force transmission portion that is in contact with the heating member in a state where the nip forming portion is set at a position separated from the heating member and transmits a rotational driving force to the heating member.

2. The heating device according to claim 1, further comprising:

a moving unit that moves the pressure member in the direction approaching or away from the heating member, wherein the moving unit sets the nip forming portion of the pressure member at a position separated from the heating member until the heating member is heated to a predetermined temperature, and sets the nip forming portion at a position pressing the heating member when the heating member is heated to the predetermined temperature.

3. The heating device according to claim 2, wherein the nip forming portion and the driving force transmission portion are formed separately, and both are secured to a rotating shaft of the pressure member.

4. The heating device according to claim 3, wherein the nip forming portion and the driving force transmission portion are arranged to be separated from each other in a direction of the rotating shaft of the pressure member.

5. The heating device according to claim 2, further comprising:

an elastic member that is arranged inside the heating member and elastically deformed by a pressing force from the pressure member to form the nip portion, the elastic member being configured to have an elastic deformation ratio that is lower at a region thereof facing the driving force transmission portion than at a region thereof facing the nip forming portion.

6. An image forming apparatus comprising:

an image forming unit that forms an image;

a transfer unit that transfers the image formed by the image forming unit onto a recording medium; and a heating unit that heats the recording medium on which the image has been transferred, the heating unit including:

a heating member including a heat generation layer that generates heat by electromagnetic induction, and heating the recording medium by electromagnetic induction heating of the heat generation layer; and a pressure member configured to be movable in a direction approaching or away from the heating member, and forming a nip portion with the heating member therebetween, through which the recording medium passes, the pressure member being configured to include: a nip forming portion that forms the nip portion with the heating member therebetween in a state where the pressure member is set at a position in contact with the heating member while pressing the heating member;

and a driving force transmission portion that is in contact with the heating member in a state where the nip forming portion is set at a position separated from the heating member and transmits a rotational driving force to the heating member.

7. The image forming apparatus according to claim 6, wherein the heating unit further includes a moving unit that moves the pressure member in the direction approaching or away from the heating member, the moving unit setting the nip forming portion of the pressure member at a position separated from the heating member until the heating member is heated to a predetermined temperature, and setting the nip forming portion at a position pressing the heating member when the heating member is heated to the predetermined temperature.

8. A heating device comprising:

a heating member heating a recording medium by being heated by a heating body; and a pressure member configured to be movable in a direction approaching or away from the heating member, and forming a nip portion with the heating member therebetween, through which the recording medium passes, the pressure member being configured to include: a nip forming portion that forms the nip portion with the heating member therebetween in a state where the pressure member is set at a position in contact with the heating member while pressing the heating member; and a driving force transmission portion that is in contact with the heating member in a state where the nip forming portion is set at a position separated from the heating member and transmits a rotational driving force to the heating member.

9. The heating device according to claim 8, further comprising:

a moving unit that moves the pressure member in the direction approaching or away from the heating member, wherein the moving unit sets the nip forming portion of the pressure member at a position separated from the heating member until the heating member is heated to a predetermined temperature, and sets the nip forming portion at a position pressing the heating member when the heating member is heated to the predetermined temperature.

10. The heating device according to claim 9, wherein the nip forming portion and the driving force transmission portion are formed separately, and both are secured to a rotating shaft of the pressure member.

11. The heating device according to claim 10, wherein the nip forming portion and the driving force transmission portion are arranged to be separated from each other in a direction of the rotating shaft of the pressure member.

12. The heating device according to claim 9, further comprising:

an elastic member that is arranged inside the heating member and elastically deformed by a pressing force from the pressure member to form the nip portion, the elastic member being configured to have an elastic deformation ratio that is lower at a region thereof facing the driving force transmission portion than at a region thereof facing the nip forming portion.

* * * * *